US011518181B2

(12) United States Patent
Washizawa

(10) Patent No.: US 11,518,181 B2
(45) Date of Patent: Dec. 6, 2022

(54) PRINTING APPARATUS

(71) Applicant: SEIKO EPSON CORPORATION, Tokyo (JP)

(72) Inventor: Takehito Washizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/215,553

(22) Filed: Mar. 29, 2021

(65) Prior Publication Data

US 2021/0300072 A1 Sep. 30, 2021

(30) Foreign Application Priority Data

Mar. 31, 2020 (JP) ..... JP2020-062276

(51) Int. Cl.
*B41J 29/38* (2006.01)
*B41J 11/00* (2006.01)
*B41J 13/00* (2006.01)

(52) U.S. Cl.
CPC ..... *B41J 11/0085* (2013.01); *B41J 13/0009* (2013.01)

(58) Field of Classification Search
None
See application file for complete search history.

(56) References Cited

U.S. PATENT DOCUMENTS

2002/0126191 A1 9/2002 Fujioka
2012/0062638 A1* 3/2012 Toya ..... B41J 11/0085 347/16
2013/0342601 A1 12/2013 Yoshida et al.
2019/0358950 A1* 11/2019 Sugimoto ..... B23Q 5/14

FOREIGN PATENT DOCUMENTS

JP 2004-307185 11/2004
JP 2008055724 A * 3/2008 ..... B41J 11/0025
JP 2009025066 A * 2/2009
JP 2014-005108 1/2014
JP 2018001531 A * 1/2018

* cited by examiner

*Primary Examiner* — Erica S Lin
*Assistant Examiner* — Tracey M McMillion
(74) *Attorney, Agent, or Firm* — Workman Nydegger

(57) ABSTRACT

A printing apparatus includes a conveyance unit configured to convey a medium, a suction unit configured to suction the medium, a control unit configured to control the conveyance unit and the suction unit, and a communication interface configured to communicate with a server apparatus. The control unit performs preliminary conveyance in which the conveyance unit conveys the medium in a state where the suction unit performs suction, measures a load determination value that changes in accordance with a conveyance load of the medium in the preliminary conveyance, acquires a conveyance load coefficient on a basis of the load determination value and a suction force of the suction unit, and transmits, to the server apparatus through the communication interface, the conveyance load coefficient or parameter determination information, together with medium type information about a type of the medium. the parameter determination information includes the load determination value and the suction force.

5 Claims, 5 Drawing Sheets

PRINTING APPARATUS

The present application is based on, and claims priority from JP Application Serial Number 2020-062276, filed Mar. 31, 2020, the disclosure of which is hereby incorporated by reference herein in its entirety.

BACKGROUND

1. Technical Field

The invention relates to a printing apparatus that performs printing on a medium.

2. Related Art

For example, JP-A-2004-307185 discloses a printing apparatus such as an ink-jet printer that conveys a medium such as a sheet along a predetermined conveyance path and performs printing by discharging liquid such as ink to the medium from a recording head. In such a printing apparatus, the medium is conveyed along a conveyance surface located opposite the recording head. However, when the medium floats from the conveyance surface during the discharging of the liquid to the medium, the printing quality may be reduced due to variations in the distance between the recording head and the medium.

In view of this, such a printing apparatus includes a suction unit configured to suction the medium from a plurality of suction ports that is open at the conveyance surface for conveying the medium such that the suction force for suctioning the medium can be adjusted, and thus the floating of the medium from the conveyance surface can be suppressed by suctioning the medium with an appropriate suction force. In the printing apparatus disclosed in JP-A-2004-307185, when the medium is conveyed, first, the suction reaction is calculated based on the medium size and the medium type, and the conveyance amount of the medium is corrected and controlled based on the calculated suction reaction. Next, the suction reaction is calculated based on the conveyance position of the medium during the printing, and the conveyance amount of the medium is corrected based on the calculated suction reaction such that the conveyance is controlled based on the corrected conveyance amount. Thus, the conveyance amount of the medium is maintained at a constant value at all time. The suction reaction is calculated based on the product of the coefficient of friction between the conveyance surface and the medium, and the suction force.

In the printing apparatus disclosed in JP-A-2004-307185, however, the conveyance amount of a medium type whose conveyance parameter, which represents a relationship between the coefficient of friction between the medium and the conveyance surface, the suction reaction and the accumulated error of the conveyance amount, is unknown cannot be corrected in accordance with the suction reaction. As such, disadvantageously, for a medium type whose conveyance parameter used for correcting the command value of the conveyance system in accordance with the conveyance load of the medium being conveyed with a suction force applied thereto is unknown, an appropriate conveyance control cannot be performed in accordance with the medium type and the suction force.

SUMMARY

To solve the above-mentioned problems, a printing apparatus includes a conveyance unit configured to convey a medium, a suction unit configured to suction the medium at a support part configured to support the medium, a printing unit configured to perform printing on the medium supported by the support part, a control unit configured to control the conveyance unit, the suction unit and the printing unit, and a communication interface configured to communicate with an external apparatus. The control unit performs preliminary conveyance in which the conveyance unit conveys the medium in a state where the suction unit performs suction at a predetermined suction force, measures a load determination value that changes in accordance with a conveyance load of the medium in the preliminary conveyance, acquires a conveyance parameter representing a relationship between a suction force of the suction unit and the conveyance load on a basis of the load determination value and the suction force, and transmits, to the external apparatus through the communication interface, the acquired conveyance parameter or parameter determination information, together with medium type information about a type of the medium, the parameter determination information including the measured load determination value and the suction force.

DESCRIPTION OF EXEMPLARY EMBODIMENTS

First Embodiment

A printing apparatus of a first embodiment is described below with reference to the drawings.

Figure 1:
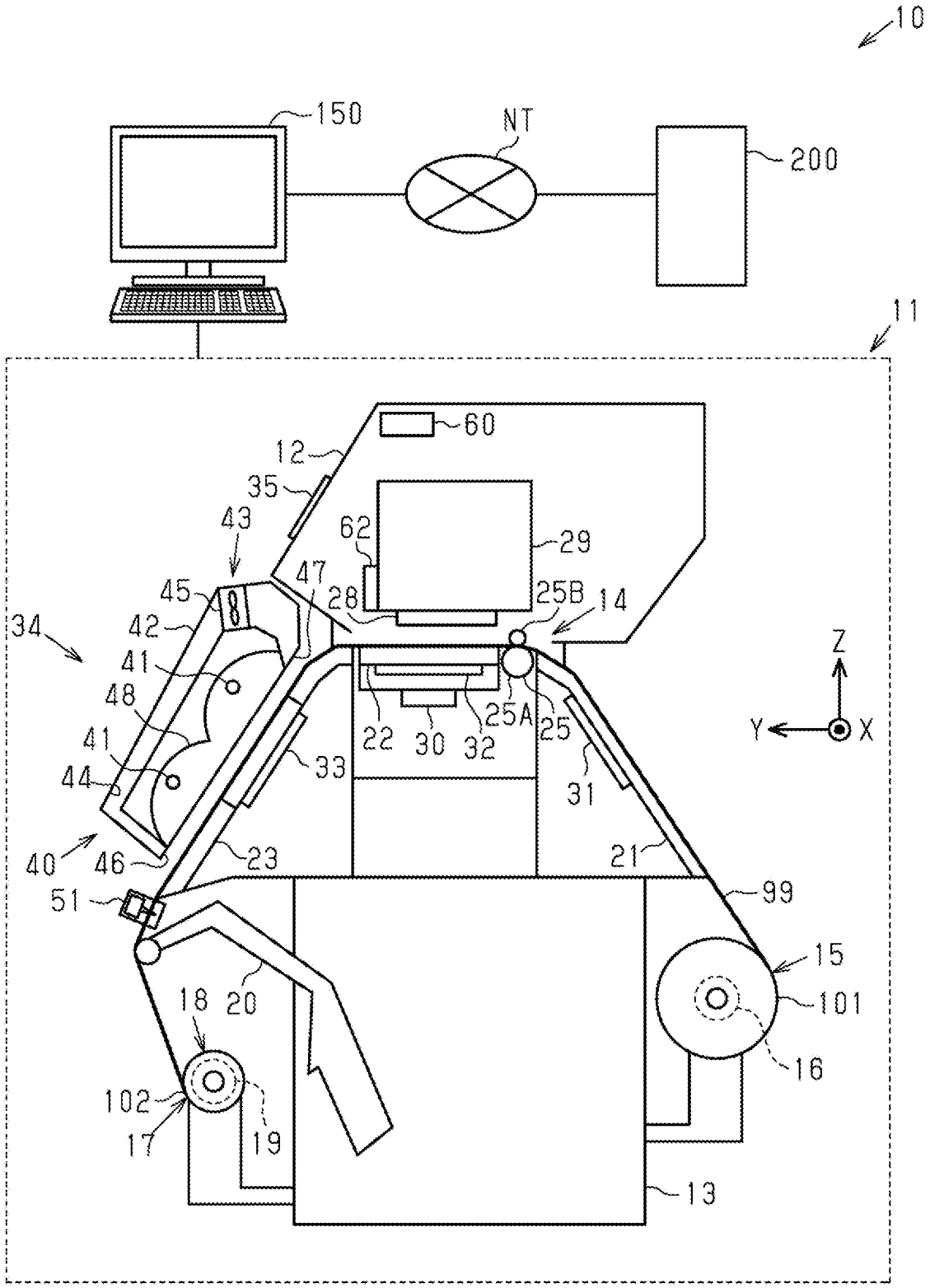
FIG. 1 is a schematic side sectional view illustrating a printing system of a first embodiment.

A printing system 10 illustrated in FIG. 1 includes a printing apparatus 11 that performs printing on a medium by discharging liquid to a medium, a host apparatus 150 for managing the printing apparatus 11, and a server apparatus 200 that communicates a variety of information with the printing apparatus 11 through the host apparatus 150. The host apparatus 150 is communicatively connected to one or a plurality of the printing apparatuses 11. The server apparatus 200 serving as an example of an external apparatus is communicatively connected to one or a plurality of the host apparatuses 150 through a network NT.

The printing apparatus 11 is an ink-jet printer that prints images such as letters and photographs by discharging ink as an example of liquid to a medium such as a sheet, for example. The printing apparatus 11 includes a housing 12 and a base 13 that supports the housing 12. Note that in FIG. 1, etc., the printing apparatus 11 is assumed to be placed on a horizontal surface, and three virtual axes orthogonal to each other are set as an X axis, a Y axis and a Z axis. The X axis is a virtual axis that is parallel to the scan direction of a printing unit 28 (described later), and the Y axis is a virtual axis that is parallel to the conveyance direction of a medium 99 in the printing region. The Z axis is a virtual axis that is parallel to the vertical direction.

The printing apparatus 11 includes a conveyance unit 14 that conveys the medium 99. The conveyance unit 14 is provided in the housing 12, and conveys the medium 99 along a predetermined conveyance path. The printing apparatus 11 includes a feeding unit 15 capable of supporting a roll member 101 composed of a roll of the medium 99 before the liquid is discharged. The feeding unit 15 is attached to the base 13 and supports the roll member 101 in a rotatable state, for example. The feeding unit 15 includes a feeding motor 16 that is driven when the roll member 101 is rotated in an unrolling direction. The conveyance unit 14 conveys the medium 99 of a long shape unrolled by the feeding unit 15 from the roll member 101. Note that in the present embodiment, the conveyance direction of the medium 99 is a direction in which the medium 99 unrolled from the roll member 101 is conveyed along the conveyance path.

The printing apparatus 11 includes the printing unit 28 that prints an image on the medium 99 by discharging liquid to the medium 99 being conveyed by the conveyance unit 14. The printing unit 28 is provided on a lower side of a carriage 29. The printing unit 28 is a printing head including a nozzle 28A (see FIG. 2) that discharges liquid such as ink, for example. The carriage 29 scans the medium 99 being conveyed, in the width direction that intersects the conveyance direction of the medium 99. That is, the printing apparatus 11 is a serial printer in which the printing unit 28 scans the medium 99. The printing apparatus 11 may be a line printer in which the printing unit 28 is disposed in a long shape capable of simultaneously discharging liquid over the width range of the medium 99. Note that the printing unit 28 and the carriage 29 are disposed in the housing 12.

The printing apparatus 11 includes an image-capturing unit 62 that captures an image of the surface of the medium 99. The image-capturing unit 62 of the present embodiment is attached to the carriage 29 on a surface on the downstream side of the conveyance path such that it is located on the downstream side in the conveyance direction of the carriage 29. The image-capturing unit 62 can capture an image printed on the medium 99 by emitting light toward the medium 99 and receiving light reflected by the medium 99.

The printing apparatus 11 includes a winding unit 17 that winds the medium 99 on which liquid has been discharged and an image has been printed. The winding unit 17 is attached on the base 13, for example. The winding unit 17 includes a reel mechanism 18 that can wind up the medium 99 on which liquid has been discharged and printed as a roll member 102. The reel mechanism 18 includes a winding motor 19 that is driven when winding up the roll member 102. In this manner, in the present embodiment, the printing apparatus 11 includes the winding unit 17 downstream of a support part 22 in the conveyance path of the medium 99, and the medium 99 is conveyed in the state where the front end of the medium 99 is fixed by the winding unit 17.

The printing apparatus 11 includes a tension bar 20 that applies tension to the medium 99. The length of the medium 99 between the winding unit 17 and the conveyance unit 14 varies depending on the difference between the feeding amount of the medium 99 at the winding unit 17 and the feeding amount of the medium 99 at the conveyance unit 14. The tension bar 20 is displaced in accordance with the length of the medium 99 between the winding unit 17 and the conveyance unit 14. In this manner, through the displacement of the tension bar 20 that makes contact with the medium 99, an appropriate tension is applied to the medium 99. By applying a tension to the medium 99 by the tension bar 20, liquid can accurately impinge on the medium 99. The tension bar 20 makes contact with the medium 99 at a portion that has passed through a drying apparatus 40 and has not been wound by the winding unit 17. The tension bar 20 is attached to the base 13, for example. The tension bar 20 is attached in such a manner that it is displaceable with respect to the base 13. Through the displacement of the tension bar 20, the value of the tension applied to the medium 99 is adjusted.

The printing apparatus 11 includes an upstream support part 21, the support part 22 and a downstream support part 23, which constitute the conveyance path that conveys the medium 99. The upstream support part 21, the support part 22 and the downstream support part 23 support the medium 99 being conveyed by the conveyance unit 14. The upstream support part 21, the support part 22, and the downstream support part 23 are located in this order from the upstream side to the downstream side in the conveyance path. The support part 22 is located in the housing 12. Specifically, the upstream support part 21 constitutes an upstream portion of the conveyance path, and supports the medium 99 at a portion from the feeding unit 15 to the conveyance unit 14. The support part 22 constitutes a middle portion of the conveyance path, and supports the medium 99 at a portion downstream of the conveyance unit 14 and opposite to the printing unit 28. In particular, the support part 22 supports a portion of the medium 99 where liquid is discharged from the printing unit 28. The support part 22 is a platen that supports the medium 99, for example. The downstream support part 23 constitutes a downstream portion of the conveyance path, and supports a printed portion, where liquid discharged from the printing unit 28 has been attached, of the medium 99 conveyed downstream by the conveyance unit 14. In the example illustrated in FIG. 1, the support part 22 is horizontally disposed, and the upstream support part 21 and the downstream support part 23 located on both sides of the support part 22 in the conveyance direction are disposed in a tilted state, and thus, an arc-shaped conveyance path with a top surface extended in the horizontal direction is formed. Note that the printing apparatus 11 may include a horizontally extended conveyance path.

The conveyance unit 14 includes a conveyance roller pair 25. The conveyance roller pair 25 is located between the upstream support part 21 and the support part 22 in the conveyance path. The conveyance roller pair 25 is composed of a driving roller 25A and a driven roller 25B. That is, the conveyance roller pair 25 is a roller pair that can nip the medium 99 between the driving roller 25A and the driven roller 25B. The conveyance roller pair 25 is switched between a separation state where the driving roller 25A and the driven roller 25B are separated from each other, and a nip state where the medium 99 is sandwiched between the driving roller 25A and the driven roller 25B. In the present embodiment, the printing apparatus 11 is provided with an operation lever (not illustrated) configured to be operated by the user, and the driving roller 25A and the driven roller 25B can be switched between the separation state and the nip state by operating the operation lever. The conveyance roller pair 25 conveys the medium 99 with the driving roller 25A and the driven roller 25B rotating in the nip state where the medium 99 is sandwiched therebetween. The driving roller 25A uses a conveyance motor 65 (see FIG. 3) as the power source to convey the medium 99. In this manner, the conveyance unit 14 includes the conveyance motor 65 for conveying the medium 99. Note that the conveyance unit 14 may include a nip force adjustment mechanism configured to be able to change the nip force that is a force of sandwiching the medium 99 between the driving roller 25A and the driven roller 25B. In the case where the conveyance unit 14 is configured to include the nip force adjustment mechanism, the nip force may be adjusted using the nip force adjustment mechanism in accordance with the type of the medium 99.

The printing apparatus 11 includes the above-described printing unit 28 that discharges liquid to the medium 99 supported by the support part 22. The printing unit 28 is located in the housing 12. The printing unit 28 is disposed at a position facing the support part 22. Thus, the printing unit 28 performs printing by discharging liquid to the medium 99 supported by the support part 22.

On the lower side of the support part 22, a suction unit 30 that suctions the medium 99 to the support part 22 with a negative pressure is provided. The suction unit 30 attaches the medium 99 to the support surface 22A with a suction force of a negative pressure by exerting a negative pressure on a suction port 36 (see FIG. 2) that is open at a support surface 22A that is a surface with which the medium 99 supported by the support part 22 makes contact. In this manner, the suction unit 30 suctions the medium 99 at the support part 22.

In addition, the upstream support part 21, the support part 22 and the downstream support part 23 include heaters 31, 32 and 33, respectively. Specifically, the preheater 31 that heats the upstream support part 21 is provided at the rear surface of the upstream support part 21, the platen heater 32 that heats the support part 22 is provided at the rear surface of the support part 22, and the after heater 33 that heats the downstream support part 23 is provided at the rear surface of the downstream support part 23. The preheater 31 preheats a pre-printing portion of the medium 99. The platen heater 32 heats a portion of the medium 99 in a discharge region to which liquid is discharged from the nozzle 28A (see FIG. 2) of the printing unit 28. The after heater 33 heats a printed portion of the medium 99. Note that the heaters 31 to 33 are planar heaters, for example.

The printing apparatus 11 includes a heating unit 34 that heats the medium 99 being conveyed with liquid attached thereto. The heating unit 34 is located downstream of the position where liquid is discharged by the printing unit 28 in the conveyance path. Thus, the heating unit 34 heats and dries the medium 99 on which liquid is attached.

In the present embodiment, the heating unit 34 is the drying apparatus 40 including a heater tube 41. The heater tube 41 is located to face the downstream support part 23 that supports the printed medium 99. The heater tube 41 heats the printing surface of the medium 99 being conveyed with the support of the downstream support part 23. The heater tube 41 is controlled at a predetermined heating setting temperature to appropriately dry liquid attached on the medium 99. In this case, the higher the heating setting temperature, the larger the output of the heater tube 41.

The drying apparatus 40 includes a case 42 that houses the heater tube 41, and a circulation unit 43 that circulates gas in the case 42. The case 42 is arranged at a position facing the downstream support part 23. The circulation unit 43 includes a circulation path 44 through which gas flows, and a ventilating fan 45 located at a middle portion of the circulation path 44. The circulation path 44 is a channel that connects a suction port 46 that takes in gas, and an air blow port 47 that sends out gas. The circulation unit 43 circulates gas heated by the heater tube 41 along a circulation path including in a portion thereof a path flowing along the surface of the medium 99. The drying apparatus 40 includes a reflection plate 48 that reflects the heat of the heater tube 41 toward the downstream support part 23. Note that the printing apparatus 11 may not include the heating unit 34.

The printing apparatus 11 includes a cutter apparatus 51 that cuts the printed medium 99. FIG. 1 illustrates an example use in which the printed medium 99 is wound up by the winding unit 17 as the roll member 102. The printing apparatus 11 may use the cutter apparatus 51 to cut the printed medium 99 into a plurality of pieces of a predetermined size. The cutter apparatus 51 includes a movable blade and a fixed blade, and the movable blade moves in the width direction of the medium 99 to cut the medium 99 in a unit of a predetermined length in the conveyance direction, for example.

The printing apparatus 11 includes a control unit 60. The control unit 60 generally controls the printing apparatus 11. That is, the control unit 60 controls the conveyance unit 14, the feeding unit 15, the winding unit 17, the printing unit 28, the suction unit 30, the heating unit 34 and the like. In addition, the printing apparatus 11 includes an operation unit 35 that is operated by the user to give instructions to the printing apparatus 11. A signal resulting from an operation on the operation unit 35 is output to the control unit 60.

Figure 2:
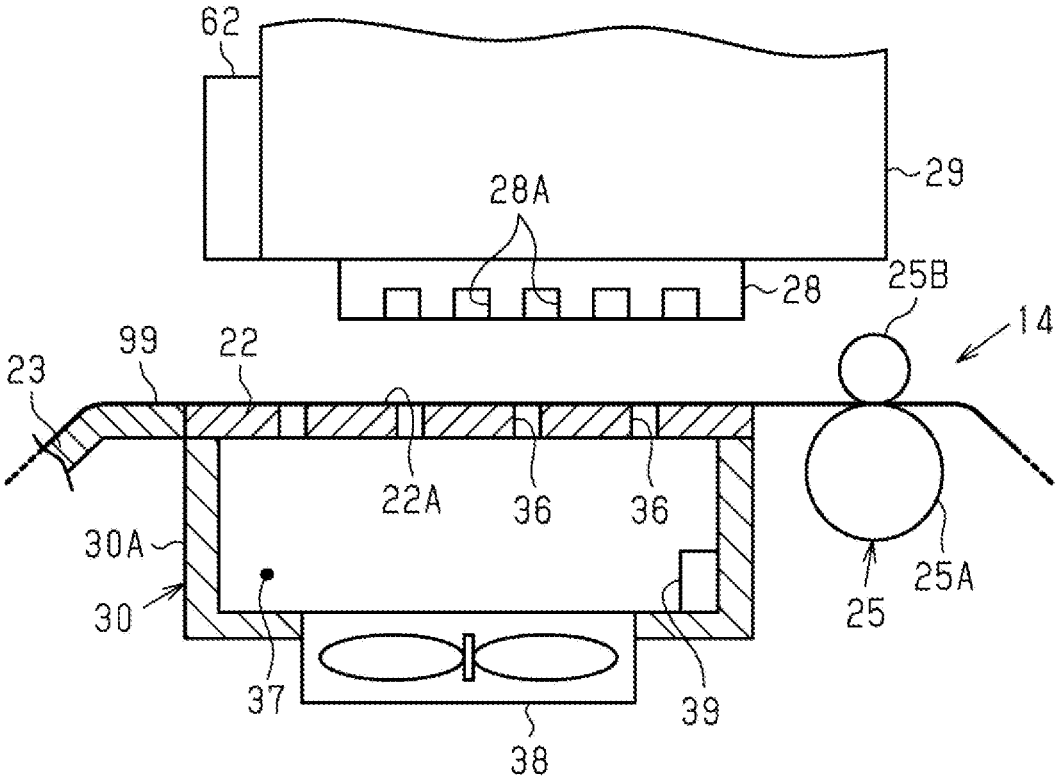
FIG. 2 is a schematic side sectional view illustrating a suction unit.

Next, with reference to FIG. 2, a specific configuration of the suction unit 30 is described. As illustrated in FIG. 2, the support part 22 includes the suction port 36 that is open at the support surface 22A with which the medium 99 makes contact. The printing apparatus 11 includes the suction unit 30 that generates a negative pressure for applying a suction force for suctioning the medium 99 to the suction port 36. On the lower side of the support part 22, a negative pressure chamber formation member 30A is mounted. A negative pressure chamber 37 is surrounded and formed by the support part 22 and the negative pressure chamber formation member 30A. The suction port 36 is extended through the support part 22 and is communicated with the negative pressure chamber 37. A plurality of the suction ports 36 communicated with the negative pressure chamber 37 is open at the support surface 22A. The suction unit 30 includes an exhaust fan 38 that discharges air in the negative pressure chamber 37 to the outside. When the exhaust fan 38 is driven, the air in the negative pressure chamber 37 is discharged to the outside, and the interior of the negative pressure chamber 37 is set to a negative pressure. Accordingly, the medium 99 is attached to the support surface 22A with a negative pressure that acts on the plurality of the suction ports 36 that is open at the support surface 22A.

In the printing apparatus 11, in printing of an image to the medium 99 with liquid discharged from the printing unit 28, the exhaust fan 38 is driven, and the medium 99 is attached to the support surface 22A. In addition, in the negative pressure chamber 37, a pressure sensor 39 that detects a pressure is provided. In the present embodiment, a negative pressure acts on the suction port 36 also when the medium 99 is being conveyed, and a suction force toward the support surface 22A acts on the medium 99 being conveyed. In this case, an excessive suction force in the conveyance process of the medium 99 may increase the conveyance load of the medium 99.

Figure 3:
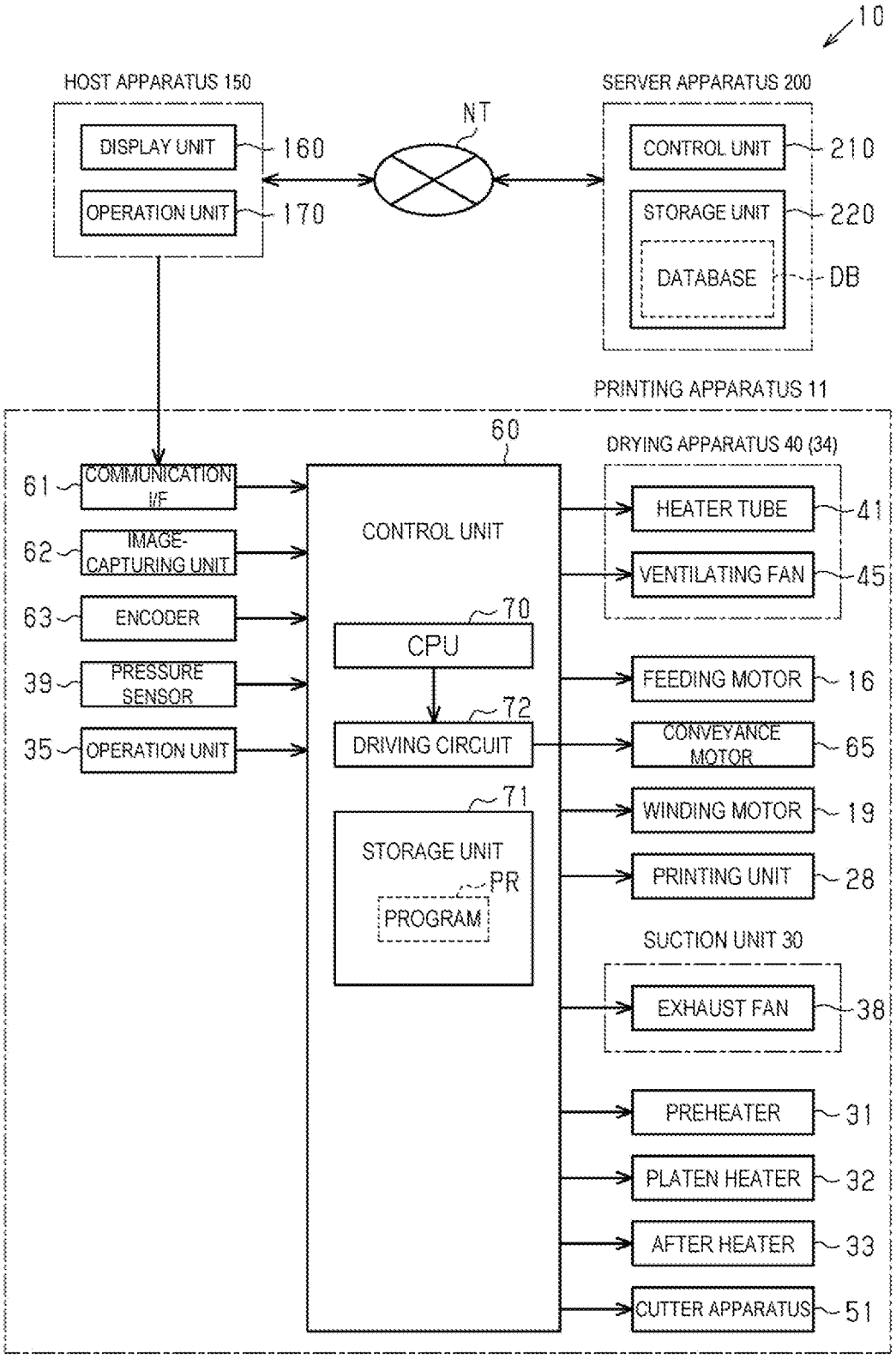
FIG. 3 is a block diagram illustrating an electrical configuration of the printing system.

Next, an electrical configuration of the printing system 10 is described with reference to FIG. 3. The printing system 10 includes the printing apparatus 11, the host apparatus 150, and the server apparatus 200.

The printing apparatus 11 includes the control unit 60. The control unit 60 includes a CPU 70, an application specific integrated circuit (ASIC (an IC for specific use)(not illustrated), and a storage unit 71 (memory) composed of a RAM, a nonvolatile memory or the like. The CPU 70 executes a program PR stored in the storage unit 71 to manage various controls including a printing control. The program PR is stored in the storage unit 71, and is executed by the control unit 60 after the power of the printing apparatus 11 is turned on.

A communication interface 61, the image-capturing unit 62, an encoder 63 and the pressure sensor 39 are electrically connected to the control unit 60. The control unit 60 is communicatively connected to the host apparatus 150 through the communication interface 61. In addition, since the host apparatus 150 and the server apparatus 200 can communicate with each other, the communication interface 61 can be said to be able to communicate with the server apparatus 200. The image-capturing unit 62 captures an image of the surface of a medium and outputs the captured image data to the control unit 60. The encoder 63 detects the driving amount of the conveyance motor 65, and outputs a signal representing the driving amount of the conveyance motor 65 to the control unit 60. The pressure sensor 39 detects the pressure of the negative pressure chamber 37 of the suction unit 30 and outputs a signal representing the detected pressure to the control unit 60.

In addition, the control unit 60 includes a plurality of driving circuits (not illustrated) such as a driving circuit 72 that drives and controls the conveyance motor 65. The heater tube 41, the ventilating fan 45, the feeding motor 16, the conveyance motor 65 serving as the driving source of the driving roller 25A of the conveyance unit 14, the winding motor 19, the printing unit 28, the suction unit 30, the preheater 31, the platen heater 32 and the after heater 33 are electrically connected to the control unit 60 through the plurality of driving circuits (not illustrated). In particular, the conveyance motor 65 is a motor for controlling the driving of the driving roller 25A through the control unit 60. In addition, in the present example in which the printing apparatus 11 is a serial printer, a carriage motor (not illustrated) serving as a driving source of the carriage 29 is electrically connected to the control unit 60. Note that in the case where the printing apparatus 11 is composed of a line printer, no carriage motor is provided, and therefore an electrical configuration illustrated in FIG. 3 is provided.

The host apparatus 150 includes a display unit 160 and an operation unit 170 that is operated by the user. Note that the host apparatus 150 is composed of any one of a personal computer, a mobile information terminal (Personal Digital Assistants (PDA)), a tablet PC, a smartphone, a mobile phone and the like, for example.

In addition, the host apparatus 150 and the server apparatus 200 are communicatively connected to each other through the network NT. The server apparatus 200 includes a control unit 210 and a storage unit 220. In the server apparatus 200, the storage unit 220 stores a database DB that performs centralized management of data related to the printing apparatus 11.

In the present embodiment, the host apparatus 150 includes a printing driver (not illustrated) that generates printing job data when printing is instructed by the user through an operation of the operation unit 170, and transmits the generated printing job to the control unit 60. In the following description, "printing job" is also simply referred to as "job". The job includes various commands required for printing control, printing condition information specified by the user, and printing image data. In addition, in the present embodiment, the printing condition information includes information about the printing mode and the medium type.

The printing mode is a mode related to a control of printing an image on the medium 99. In the present embodiment, the printing mode includes a plurality of modes such as a high-speed printing mode and a high-definition printing mode, for example. For example, the high-definition printing mode is a printing mode that prioritizes the printing image quality over the printing speed, and the high-speed printing mode is a printing mode that prioritizes the printing speed over the printing image quality. To print a high-definition image, it is necessary to increase the printing resolution, but the printing speed is reduced when the printing resolution is increased. The printing mode has a plurality of levels in accordance with the priority levels of the printing image quality and the printing speed. The control unit 60 performs a printing control at a printing speed in accordance with the printing mode selected by the user from among the plurality of printing modes. The printing speed includes the conveyance speed for conveying the medium 99. In addition, in a serial printer, the printing speed includes the conveyance speed and the scan speed of the printing unit 28 moving in the scan direction X. That is, the printing mode is also information that defines the conveyance speed of the medium 99.

In addition, the type of the medium is classified by the shape, size, thickness, material, fiber form, surface form and the like of the medium 99. The type of the medium is classified by the medium type and the medium size, for example. As specific examples, in the case where the medium 99 is paper, the medium type is classified by the difference in thickness and surface form of the medium 99, and examples of the type include plain paper, photograph paper, and gloss paper. In the case where the medium 99 is roll paper, the medium size is classified by the sheet width size. In addition, in the case where the medium 99 is fabric, the medium type is classified by the difference in material (such as the fiber material) and/or fiber form (such as the weave form) of the medium 99, and examples of the types include types related to the material such as cotton, wool, silk, and artificial fiber and types related to the textile texture such as plain weave, twill weave, and satin weave. In this case, it may be further classified by the thread thickness. In addition, it may be classified by the type related to the grain of the fabric (the grain size). The type related to the textile texture, the type by the thread thickness, and the type related to the grain of the fabric define the breathing property of the medium 99.

In the present embodiment, when the control unit 60 receives data of a job from the host apparatus 150 through the communication interface 61, the control unit 60 controls various types of motors 16, 19 and 65 and the like on the basis of the printing condition information, and controls the printing unit 28 on the basis of the image data to discharge liquid from the nozzle 28A that can draw dotted images. In the present embodiment, the host apparatus 150 may transmit the printing condition information and the printing image data separately to the control unit 60 at different timings, and the control unit 60 may receive the printing condition information and the image data separately from the host apparatus 150. In addition, in the present embodiment, the printing condition information may be created based on the printing condition input by the user through an operation on the operation unit 35 of the printing apparatus 11 or the operation unit 170 of the host apparatus 150.

In particular, in the present embodiment, the control unit 60 conveys the medium 99 at the conveyance speed in accordance with the printing mode. In the storage unit 71, reference data representing a correspondence relationship between the printing mode and the conveyance speed is stored. The control unit 60 refers to the reference data on the basis of a specified printing mode to acquire the target conveyance speed corresponding to the printing mode. Here, the conveyance process of the medium 99 includes an acceleration zone, a constant speed zone and a deceleration zone. The target conveyance speed is a constant speed in the constant speed zone. In the storage unit 71, speed control data for conveyance control is stored. The speed control data is data in which a target speed in each of the acceleration zone, the constant speed zone and the deceleration zone is set. The speed control data is composed of a plurality of conveyance positions obtained by dividing the range from a conveyance start position as the origin to a conveyance completion position into sections in a unit of a small distance, and a plurality of target speeds corresponding to the plurality of conveyance positions. The target conveyance speed is a target speed of the constant speed zone.

When performing the conveyance control, the CPU 70 outputs a command value to the driving circuit 72. The command value includes a current command value and a distance command value. The current value command value is a command value that commands the supply current to the conveyance motor 65. The distance command value is a command value that commands the conveyance distance by which the medium 99 is conveyed in a single conveyance operation. The CPU 70 outputs a current command value corresponding to a target conveyance speed to the driving circuit 72. The driving circuit 72 supplies a supply current having a value corresponding to the current command value to the conveyance motor 65. The conveyance motor 65 is controlled at a speed corresponding to the supply current. More specifically, the CPU 70 acquires a current conveyance position from a detection value of the encoder 63. In the acceleration zone and the deceleration zone, the CPU 70 acquires the target speed corresponding to the current conveyance position with reference to the speed control data, and outputs the current command value corresponding to the target speed to the driving circuit 72.

The control unit 60 performs a feedback-control of reducing a difference between the target speed corresponding to the current command value and the actual speed of the conveyance motor 65 detected by the encoder 63. Specifically, in accordance with a program, the CPU 70 performs a feedback-control of correcting the next current command value by a correction amount corresponding to the difference between the target speed and the actual speed based on a detection signal from the encoder 63, and outputting the current command value after the correction to the driving circuit 72 at the next command timing. Note that the feedback-control may be implemented by a hardware configuration in which it is executed by the driving circuit 72, instead of the software configuration in which it is executed by the CPU 70 in accordance a program.

In addition, in the present embodiment, the control unit 60 performs a synchronization control of controlling the feeding motor 16 and the conveyance motor 65 so as to adjust the unrolling feeding amount from the roll member 101 at the feeding motor 16 to the conveyance amount of the conveyance motor 65. Here, when the conveyance load of the medium 99 is large and the rotational speed of the driving roller 25A is lower than a target speed, the feeding amount of the medium 99 unrolled from the roll member 101 per unit time and the conveyance amount of the medium 99 conveyed by the conveyance roller pair 25 per unit time do not coincide with each other even when the synchronization control of the feeding motor 16 and the conveyance motor 65 is performed. Consequently, an excessive tension or slack may occur in the medium 99. The current command value is set such that the conveyance motor 65 can output an appropriate driving torque on the premise that a predetermined tension is exerted on the medium 99 at a portion between the conveyance roller pair 25 and the roll member 101. When the above-described excessive tension or slack occurs, however, the conveyance amount of the medium 99 conveyed by the conveyance roller pair 25 is varied, and the synchronization control cannot be appropriately performed. This causes wrinkles in the medium 99, and the wrinkles reduce the printing quality of images printed on the medium 99. To appropriately perform the synchronization control, it is necessary to eliminate overshooting and following delay of the actual speed with respect to the target speed due to the conveyance load of the medium 99.

In addition, a large conveyance load of the medium 99 results in following delay, in which the actual speed is delayed with respect to the target speed. In such a case, the control unit 60 increases the current command value to eliminate the following delay. As a result, the supply current to the conveyance motor 65 is increased. Specifically, the control unit 60 commands a current command value greater than the reference current command value to increase the supply current to the conveyance motor 65 in accordance with the conveyance load such that the conveyance motor 65 is driven at the target speed. The control unit 60 can acquire the load current of the conveyance motor 65 from the output current command value.

In addition, in the printing apparatus 11, one suction negative suction pressure can be set from among negative pressures of three or more levels. The control unit 60 sets a target suction negative pressure on the basis of a plurality of pieces of information including the printing mode and the medium type of the printing condition information. In the present embodiment, the control unit 60 generates a negative pressure at the negative pressure chamber 37 by controlling the exhaust fan 38 such that the exhaust fan 38 rotates at a target rotational speed corresponding to a target suction negative pressure. In this manner, a suction negative pressure is exerted on the suction port 36 that is open at the support surface 22A of the support part 22. After the detection pressure of the pressure sensor 39 has reached the target suction negative pressure, the control unit 60 starts preliminary conveyance of the medium 99 and a main conveyance of the medium 99 for printing. The medium 99 conveyed by the conveyance unit 14 is suctioned to the support part 22 by a predetermined suction force corresponding to the suction negative pressure.

Here, the suction force of the suction unit 30 is indicated by the product of the total pressure reception area where the suction negative pressure is exerted on the medium 99 and the suction negative pressure. For example, the support part 22 includes a configuration in which the suction port 36 is open at the support surface where the medium 99 is supported, and a configuration in which a recess communicated with the suction port is provided in the support surface. In the former configuration, the total pressure reception area of the medium 99 is equal to the total opening area of the suction port 36 that is closed by the medium 99. In the latter configuration, the total pressure reception area of the medium 99 is equal to the total opening area of the recess. The force in the suction direction received by the medium 99 with the suction force is equal to the suction force when the pressure drop is negligible. In the conveyance position range where the front end of the medium 99 is located on the support surface 22A, the number of the suction ports 36 closed with the medium 99 changes, and therefore the force in the suction direction received by the medium 99 changes. In the conveyance position range where the support surface 22A is sandwiched between the front end and the rear end of the medium 99 in the conveyance direction, the number of the suction ports 36 closed with the medium 99 is constant even when the conveyance position of the medium 99 changes, and therefore the force in the suction direction received by the medium 99 is constant. In addition, when the width of the medium 99 differs, the number of the suction ports 36 closed with the medium 99 differs, and therefore the force in the suction direction received by the medium 99 differs depending on the size of the medium 99.

In addition, when the medium 99 is conveyed, a load current corresponding to the conveyance load of the medium 99 flows in the conveyance motor 65 through the driving roller 25A. When the exhaust fan 38 is driven, the medium 99 is suctioned in the suction direction toward the support surface 22A by the suction force corresponding to the suction negative pressure exerted on the medium 99 through the suction port 36. In this manner, the medium 99 is attached on the support surface 22A. To the conveyance load when the medium 99 attached on the support surface 22A is conveyed, a conveyance load based on the suction force is added. Therefore, the conveyance load of the medium 99 changes in accordance with the suction force. In addition, the conveyance load of the medium 99 differs depending on the model of the printing apparatus 11 and the medium type.

As a specific example, depending on the model of the printing apparatus 11, the material of the support part 22, the shape and size of the suction port 36, the number of suction ports 36 per unit area of the support surface 22A, the shape of the negative pressure chamber 37, the performance of the exhaust fan 38 and the like differ. Accordingly, even with the same type of the medium 99 and the same suction negative pressure, the conveyance load of the medium 99 differs when the model is different.

In addition, when the medium 99 is paper or a synthetic resin film, the coefficient of friction of the medium 99 with respect to the support surface 22A differs depending on the medium type. When the medium 99 is paper, the type of the medium includes plain paper and photograph paper. When the medium 99 is fabric or knitted fabric, the coefficient of friction and the air permeability differ depending on the type of the medium. Here, the air permeability indicates the ease of air passage through gaps in the texture of the medium 99 when a predetermined pressure is applied to both the front and rear sides of the medium 99. The air permeability is indicated by a flow velocity of air that passes through gaps in the texture of the medium 99 per unit area when a predetermined pressure is applied to both the front and rear sides of the medium 99, for example. The smaller the air permeability, the higher the breathability. Even with the same suction negative pressure of the suction unit 30, when the medium is of a type with a high breathability in which the air permeability of the medium 99 is small, the force in the suction direction received by the medium 99 is small due to a pressure drop resulting from air leakage due to as large amount of air that passes through gaps in the texture of the medium 99 per unit time. Therefore, even with the same model and the same suction negative pressure, the conveyance load of the medium 99 differs between the medium types differing in breathability.

Here, a frictional force in the −Y direction received by the medium 99 being conveyed from the support surface 22A is indicated by the product of the coefficient of friction and the normal reaction received from the support surface 22A at the medium 99. The normal reaction is a value obtained by adding up a normal reaction component of the own weight of the medium 99 and a normal reaction component of the force in the suction direction received by the medium 99. As such, the normal reaction changes in accordance the suction force of the suction unit 30. The frictional force component based on the normal reaction of the force in the suction direction received by the medium 99 with the suction force is expressed as the product of the normal reaction component and the coefficient of friction. In the medium 99 with a significantly low breathability, the force in the suction direction received by the medium 99 with the suction force is equal to the suction force. In addition, in the medium 99 of fabric or the like having a higher breathability than a sheet, the force in the suction direction received by the medium 99 with the suction force is smaller than the suction force by a pressure drop due to passage of air through the medium 99.

In addition, the frictional force received from the contact portion other than the support surface 22A at the medium 99 being conveyed can be regarded as substantially constant. When the power is switched on in the printing apparatus 11, an initial conveyance in which the medium 99 is conveyed at a constant conveyance speed with the suction unit 30 in a stopped state is performed. The control unit 60 detects a load on the basis of the current command value output in a constant speed process during the initial conveyance, and determines a reference current command value in accordance with the detected load. The reference current command value is a value that takes into account conveyance loads due to factors other than the suction force.

The current command value for conveying the medium 99 at the target conveyance speed in the state where the suction force of the suction unit 30 is applied thereto is set to a value greater than the reference current command value for conveying the medium 99 at the target conveyance speed in the state where the suction force of the suction unit 30 is not applied thereto. In addition, even with the same suction force of the suction unit 30, when the type of the medium differs, the coefficient of friction of the medium 99 with respect to the support surface 22A differs, and therefore the increase of the conveyance load due to the suction force differs depending on the type of the medium Therefore, it is necessary to set the current command value corresponding to the suction negative pressure and the medium type.

In the printing apparatus 11 of the present embodiment, when the medium 99 is conveyed at the target conveyance speed, the current command value set by the control unit 60 is calculated based on the reference current command value, the suction negative pressure of the suction unit 30, and the conveyance load coefficient. The reference current command value is a current command value for conveying the medium 99 at the target conveyance speed when the suction negative pressure is "0". The reference current command is a current command value serving as a reference for calculating a current command value to be set. A single conveyance operation includes the acceleration zone, the constant speed zone and the deceleration zone. The target conveyance speed is a constant speed in the constant speed zone. The target conveyance speed is determined based on the printing mode, the conveyance distance and the like. The reference current command value is determined based on the mechanical conveyance load measured through the initial conveyance performed by the printing apparatus 11.

The conveyance load coefficient is a conveyance parameter representing a relationship between the suction force of the suction unit 30 and the conveyance load of the medium 99. The conveyance load coefficient in the present embodiment is a coefficient representing a relationship (ratio) between the suction negative pressure and the current command value set by the control unit 60. In the present embodiment, the conveyance motor 65 is feedback-controlled, and therefore, even when the conveyance load of the medium 99 increases due to the suction force, the current command value is increased to a value greater than the reference current command value such that the medium 99 can be conveyed at the target conveyance speed. Therefore, the increment of the current command value with respect to the reference current command value is proportional to the suction negative pressure. The conveyance load coefficient is a coefficient corresponding to a proportional constant in that proportional relationship and configured for calculating the current command value corresponding to the suction negative pressure of the suction unit 30. That is, the conveyance load coefficient is a conveyance parameter for calculating a command value for the control unit 60 to control the conveyance motor 65.

Figure 4:
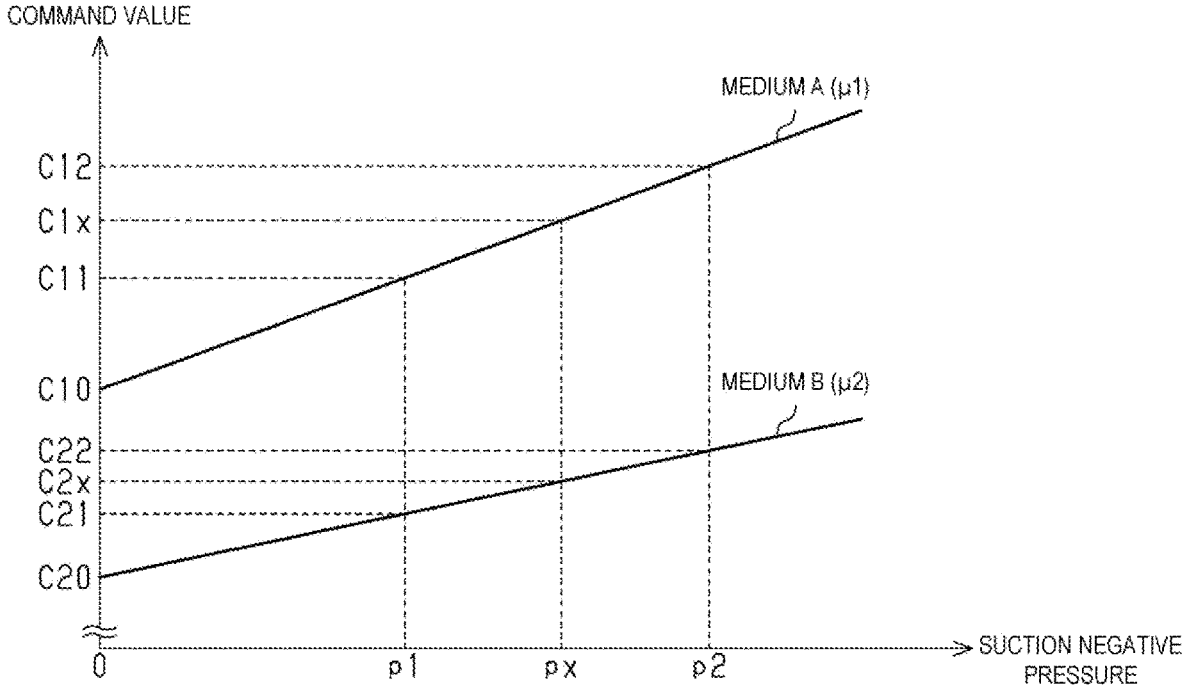
FIG. 4 is a schematic view illustrating a relationship between a current command value used for controlling a conveyance motor and a suction negative pressure of the suction unit in a printing apparatus.

More specifically, as illustrated in FIG. 4, when the type of the medium is a medium A, the conveyance load coefficient is $\mu 1$, and the reference current command value is C10. In this case, by adding a result obtained by multiplying the conveyance load coefficient $\mu 1$ and the suction negative pressure px to the reference current command value C10, a current command value C1*x* to be set can be calculated. Note that in the graph illustrated in FIG. 4, the abscissa indicates the suction negative pressure in an absolute value p, and a relationship of $0<p1<px<p2$ holds.

When the type of the medium is a medium B, the conveyance load coefficient is $\mu 2$, and the reference current command value is C20. In this case, by adding a result obtained by multiplying the conveyance load coefficient $\mu 2$ and the suction negative pressure px to the reference current command value C20, a current command value C2*x* to be set can be calculated.

In this manner, the conveyance load coefficient and the reference current command value differ depending on the type of the medium. In addition, as described above, the material of the support part 22, the shape, size and number of the suction ports 36, the performance of the exhaust fan 38 and the like differ depending on the model of the printing apparatus 11, and therefore the conveyance load coefficient in accordance with the medium type illustrated in FIG. 4 differs among the models of the printing apparatus 11 even with the medium of the same type. That is, the conveyance load coefficient depends on the model of the printing apparatus 11, the medium type and the suction negative pressure. Accordingly, by calculating the conveyance load coefficient corresponding to the type of the medium for each model of the printing apparatus 11, the medium 99 can be appropriately conveyed in accordance with the model of the printing apparatus 11, the medium type and the suction negative pressure.

In the present embodiment, in the printing apparatus 11, the preliminary conveyance for calculating the conveyance load coefficient is performed separately from the main conveyance in which printing is performed based on the printing image data included in the printing job. In the present embodiment, the control unit 60 performs the preliminary conveyance when an automatic adjustment mode is selected by the user through an operation on the operation units 35 and 170. In the preliminary conveyance, the medium 99 is conveyed at a predetermined target conveyance speed in the state where the suction unit 30 is driven at a predetermined suction negative pressure, and the control unit 60 measures a load determination value that changes in accordance with the conveyance load of the medium 99, which is required for the calculation of conveyance load coefficient. The load determination value of the present embodiment is a load current value of the conveyance motor 65 in the preliminary conveyance. Since a load current corresponding to a current command value based on the feedback-control is supplied to the conveyance motor 65, the control unit 60 can recognize the load current value of the conveyance motor 65 on the basis of the current command value output by the CPU 70. Note that the control unit 60 may store, in the storage unit 71, the conveyance load coefficient corresponding to the type of the medium previously used for printing, and perform the preliminary conveyance when it determines that a new medium type other than the type of the medium whose conveyance load coefficient is stored in the storage unit 71 is specified.

The conveyance load coefficient corresponding to the type of the medium is calculated by the control unit 60 using the current command value measured as the load determination value in the preliminary conveyance and the suction negative pressure applied at that time. The calculated conveyance load coefficient is stored in the storage unit 71 in association with the type of the medium. In particular, in the printing apparatus 11 of the present embodiment, the conveyance load coefficient is calculated based on a current command value that is measured in first preliminary conveyance in which the medium 99 is conveyed at the target conveyance speed with a first suction negative pressure p1, and a current command value that is measured in a second conveyance in which the medium 99 is conveyed at a target conveyance speed with a second suction negative pressure p2.

In this manner, in the printing apparatus 11, the conveyance load coefficients corresponding to the types of the medium for which the first preliminary conveyance and the second preliminary conveyance have been performed are stored in the storage unit 71. For the type of the medium stored in the storage unit 71 in association with the conveyance load coefficient, the current command value is specified by correcting the reference current command value on the basis of the suction negative pressure set at that time and the conveyance load coefficient associated with the type of the medium in the main conveyance of the printing operation.

Note that in the case where the conveyance motor 65 is controlled based on a reference current command value that does not take the suction negative pressure into account in the main conveyance, the following problems arise. The conveyance control may become unstable due to occurrence of following delay in the acceleration zone and/or occurrence of overshooting and the like when the constant speed zone is reached due to a large difference between the actual speed and the target speed in the feedback-control. In contrast, in the present embodiment, the control unit 60 uses the conveyance load coefficient as the conveyance parameter to set the current command value corresponding to the medium type and the suction negative pressure. In this manner, in the main conveyance, the accuracy of the feedback-control is high, and the following delay in the acceleration zone, the overshooting and the like are less likely to occur, and thus, a stable conveyance control can be performed.

For the type of the medium whose conveyance load coefficient is not stored in the storage unit 71, it is acquired by performing preliminary conveyance of the medium 99 at a constant conveyance speed and under a predetermined suction negative pressure in accordance with the printing mode, and measuring the current command value output in the preliminary conveyance as the load determination value. The preliminary conveyance is performed twice with different suction negative pressures for each type of the medium, and the conveyance load coefficient μ is calculated based on two pairs of set data of the current command value and the suction negative pressure acquired in the two preliminary conveyances. For the type of the medium whose conveyance load coefficient μ is stored in the storage unit 71 after the two preliminary conveyances are completed, a third preliminary conveyance is not performed even when it is a first-time suction negative pressure.

Note that in the printing apparatus 11 of the present embodiment, in the case where the power of the printing apparatus 11 is turned on and the case where the type of the medium is changed, the control unit 60 calculates the reference current command value for conveying the medium 99 at the target conveyance speed when the rotational speed of the exhaust fan 38 is set to "0", i.e., the suction negative pressure is set to "0", and the value is stored in the storage unit 71.

Figure 5:
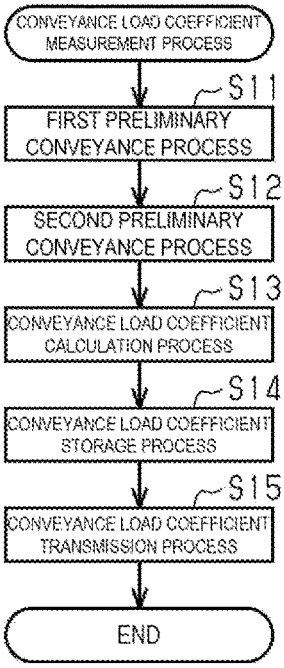
FIG. 5 is a flowchart of a conveyance load coefficient measurement process.

Here, with reference to FIG. 5, a conveyance load coefficient measurement process is described. This conveyance load coefficient measurement process is a process that is executed by the control unit 60 when the automatic adjustment mode is selected by the user and the conveyance load coefficient corresponding to the type of the medium at that time is not set and not stored in the storage unit 71. The user causes the conveyance roller pair 25 to nip the medium 99 drawn from the roll member 101 and sets the front end portion of the medium 99 to a state where it is fixed to a winding unit 18 such that it can be wound as the roll member 102. After the medium 99 has been set, the user operates the operation units 35 and 170 to set the printing condition including the type of the medium, the printing mode and the suction negative pressure. The control unit 60 performs the conveyance load coefficient measurement process when it determines that the conveyance load coefficient corresponding to the type of the medium specified by the printing job is not set and not stored in the storage unit 71. In addition, the control unit 60 does not perform the conveyance load coefficient measurement process when it determines that the conveyance load coefficient corresponding to the type of the medium specified by the printing job has been set and stored in the storage unit 71. In this case, the control unit 60 uses the conveyance load coefficient corresponding to the type of the medium read from the storage unit 71 to calculate the current command value to be commanded in a conveyance control in which the medium 99 is conveyed under the specified suction negative pressure.

In addition, the storage unit 71 stores reference data representing a correspondence relationship between the printing mode and the conveyance speed. The control unit 60 may select the conveyance speed corresponding to the printing mode by referring to the reference data. Alternatively, the conveyance speed information employed in the preliminary conveyance may be stored in the storage unit 71 in advance. In addition, reference data representing a correspondence relationship between the medium type and the suction negative pressure may be stored in the storage unit 71, and the control unit 60 may select the suction negative pressure corresponding to the medium type by referring to the reference data. In this manner, for the suction negative pressure employed in the preliminary conveyance, values selected by the user through an operation on the operation units 35 and 170 may be determined, or, on the basis of one or a plurality of pieces of information in the printing condition information, a suction negative pressure corresponding to the information may be determined. The control unit 60 executes the conveyance load coefficient measurement process illustrated in the flowchart of FIG. 5 when it determines that the conveyance load coefficient of the type of the medium that is specified is not set. At this time, the first preliminary conveyance and the second preliminary conveyance are performed with the front end portion of the medium 99 fixed to the winding unit 18 while the medium 99 conveyed by the conveyance unit 14 is wound on the roll member 102.

As illustrated in FIG. 5, at step S11, the control unit 60 executes first preliminary conveyance process. The first preliminary conveyance process is a process for performing the first preliminary conveyance for measuring the conveyance load (hereinafter referred to as "first conveyance load") when the medium 99 is conveyed under a predetermined suction negative pressure. In this process, the control unit 60 generates the first suction negative pressure by rotating the exhaust fan 38 at a first rotational speed. In this manner, the medium 99 is suctioned toward the support part 22 by a first suction force corresponding to the product of the total opening area closing the suction port 36 and the suction negative pressure. At this time, the medium 99 receives a force in the suction direction with the first suction negative pressure. Note that the control unit 60 may control the rotational speed of the exhaust fan 38 such that the detection pressure of the pressure sensor 39 is set to the first suction negative pressure.

In addition, the control unit 60 reads the reference current command value set in the initial conveyance from the storage unit 71. The reference current command value is a command value that can convey the medium 99 at a target conveyance speed in the constant speed zone even with a mechanical conveyance load in the state where the suction unit 30 is not driven. The control unit 60 refers to the speed control data set to reach the target conveyance speed in the constant speed zone. On the basis of a signal from the encoder 63, the control unit 60 sequentially acquires the current conveyance position of the medium 99 and acquires the actual speed of the conveyance motor 65. Further, the control unit 60 acquires the target speed corresponding to the current conveyance position by referring to the speed control data. The control unit 60 performs the feedback-control of bringing the actual speed closer to the target speed to change the current command value in accordance with the conveyance load. In this manner, the control unit 60 outputs a current command value having been subjected to a correction of bringing the actual speed of the conveyance motor 65 closer to the target speed in the state where the medium 99 attached on the support surface 22A with a suction force corresponding to the first suction negative pressure receives the conveyance load corresponding to the suction force. Then, the control unit 60 acquires the current command value when the medium 99 is conveyed in the state where the total opening area of the suction port 36 closed with the medium 99 is constant and the conveyance speed of the medium 99 is at the target conveyance speed in the constant speed zone, as the current command value corresponding to the first conveyance load (hereinafter referred to as "first current command value"). The control unit 60 stores the first current command value in the storage unit 71.

Here, the frictional force received by the medium 99 during the first preliminary conveyance is indicated by the sum of a first frictional force received by the medium 99 from a portion other than the support surface 22A and a second frictional force received by the medium 99 from the support surface 22A. The second frictional force is indicated by the product of the coefficient of friction and the normal reaction received by the medium 99 from the support surface 22A. This normal reaction is indicated by the sum of a first normal reaction of the own weight of the medium 99, and a second normal reaction expressed as the product of the total opening area of the suction port 36 closed with the medium 99 and the first suction negative pressure. As illustrated in FIG. 4, when the type of the medium is the medium A, a first current command value C11 is obtained in the first preliminary conveyance in which the medium 99 is conveyed at the target conveyance speed under the first suction negative pressure p1.

In this manner, the control unit 60 performs the first preliminary conveyance of controlling the conveyance motor 65 such that the conveyance unit 14 conveys the medium 99 at the target conveyance speed in the state where the suction unit 30 performs suction with the first suction force of a constant value. Then, in the first preliminary conveyance, the control unit 60 measures the current command value as an example of the load determination value that changes in accordance with the conveyance load of the medium 99. The first current command value measured in the first preliminary conveyance is a value indicating the load current of the conveyance motor 65 of the case where the medium 99 is preliminarily conveyed at the target conveyance speed in the state where the conveyance load of the first suction negative pressure is applied thereto.

Next, at step S12, the control unit 60 executes a second measurement conveyance process. The second measurement conveyance process is a process of performing second preliminary conveyance for measuring the conveyance load (hereinafter referred to as "second conveyance load") when the medium 99 is conveyed under a predetermined suction negative pressure. In this process, the control unit 60 generates a second suction negative pressure by rotating the exhaust fan 38 at a second rotational speed. In this manner, the medium 99 is suctioned toward the support part 22 by a second suction force corresponding to the product of the total opening area closing the suction port 36 and the suction negative pressure. At this time, the medium 99 receives a force in the suction direction with the second suction negative pressure. Note that the control unit 60 may control the rotational speed of the exhaust fan 38 such that the detection pressure of the pressure sensor 39 is set to the second suction negative pressure.

In addition, the control unit 60 reads the reference current command value corresponding to the medium 99 from the storage unit 71, and outputs the current based on the reference current command value to the conveyance motor 65. In this case, as in the process of step S11, the control unit 60 performs a feedback-control of bringing the actual speed closer to the target speed. The control unit 60 outputs a current command value having been subjected to a correction of bringing the actual speed of the conveyance motor 65 closer to the target speed in the state where the medium 99 attached on the support surface 22A with the suction force corresponding to the second suction negative pressure receives the conveyance load corresponding to the suction force. Then, the control unit 60 acquires the current command value when the medium 99 is conveyed in the state where the total opening area of the suction port 36 closed with the medium 99 is constant and the conveyance speed of the medium 99 is at the target conveyance speed in the constant speed zone, as the current command value corresponding to the second conveyance load (hereinafter referred to as "second current command value"). The control unit 60 stores the second current command value in the storage unit 71.

Here, the frictional force received by the medium 99 during the second preliminary conveyance is indicated by the sum of the first frictional force received by the medium 99 from a portion other than the support surface 22A and the second frictional force received by the medium 99 from the support surface 22A. The second frictional force is indicated by the product of the coefficient of friction and the normal reaction received by the medium 99 from the support surface 22A. This normal reaction is indicated by the sum of the first normal reaction of the own weight of the medium 99, and the second normal reaction expressed as the product of the total opening area of the suction port 36 closed with the medium 99 and the second suction negative pressure. As illustrated in FIG. 4, when the type of the medium is the medium A, a second current command value C12 is obtained in the second preliminary conveyance in which the medium 99 is conveyed at the target conveyance speed under the second suction negative pressure p2.

In this manner, the control unit 60 performs the second preliminary conveyance of controlling the conveyance motor 65 such that the conveyance unit 14 conveys the medium 99 at the target conveyance speed in the state where the suction unit 30 performs suction at the second suction force of a constant value. Then, the control unit 60 measures the current command value as an example of the load determination value that changes in accordance with the conveyance load of the medium 99 in the second preliminary conveyance. The second current command value measured in the first preliminary conveyance has a value indicating the load current of the conveyance motor 65 of the case where the medium 99 is preliminarily conveyed at the target conveyance speed in the state where the conveyance load of the second suction negative pressure is applied. In addition, in the present embodiment, the target conveyance speed at which the medium 99 is conveyed in the first preliminary conveyance at step S11 and the target conveyance speed at which the medium 99 is conveyed in the second preliminary conveyance at step S12 are identical to each other.

Next, at step S13, the control unit 60 executes a conveyance load coefficient calculation process of calculating the conveyance load coefficient. Specifically, in the example illustrated in FIG. 4, the control unit 60 calculates the conveyance load coefficient $\mu 1$ of the medium A using an equation $\mu 1=(C12-C11)/(p2-p1)$. The conveyance load coefficient $\mu 1$ indicates the gradient of the straight line passing through a point (p1, C11) and a point (p2, C12) illustrated in FIG. 4. The conveyance load coefficient $\mu 1$ is a coefficient representing a rate of increase of a current command value with respect to a suction negative pressure. The conveyance load coefficient $\mu 1$ is a coefficient whose product with a suction negative pressure is an increment value of a current command value with respect to a reference current command value. The conveyance load coefficient $\mu 1$ is a conveyance parameter used for calculation of a current command value that is a command value in the conveyance control performed by the control unit 60.

In this manner, the control unit 60 acquires the conveyance load coefficient corresponding to the suction force on the basis of the current command values measured in the first preliminary conveyance and the second preliminary conveyance and the set suction forces. In addition, since the control unit 60 acquires the conveyance load coefficient on the basis of the current command value in each preliminary conveyance, it can be said that the control unit 60 acquires the conveyance load coefficient on the basis of the load current of the conveyance motor 65.

Next, at step S14, the control unit 60 executes a conveyance load coefficient storage process of storing, in the storage unit 71, the calculated conveyance load coefficient in association with medium type information representing the type of the medium. In the storage unit 71, the conveyance load coefficient is stored in association with the type of the medium.

In addition, at step S15, the control unit 60 executes a conveyance load coefficient transmission process. In this process, the control unit 60 transmits, to the server apparatus 200 through the host apparatus 150, information about the date and time when the conveyance load coefficient is calculated, model information representing the model of the printing apparatus 11, medium type information representing the type of the medium, and the calculated conveyance load coefficient. In this manner, the control unit 60 transmits, to the server apparatus 200 through the communication interface 61, the acquired conveyance load coefficient together with the model information of the printing apparatus 11 and the medium type information representing the type of the medium 99. Note that the control unit 60 may transmit, to the server apparatus 200, information about the conditions in the preliminary conveyance such as the target conveyance speed, the suction negative pressure, the current command value that is the measurement value output at the target conveyance speed, and the load current value of the conveyance motor 65, together with the conveyance load coefficient, or instead of the conveyance load coefficient. In the latter case, examples of the conveyance parameter include combination information of a combination of the suction negative pressure and the current command value that enables determination of the conveyance load coefficient.

On the other hand, in the server apparatus 200, the control unit 210 stores information in which the calculated conveyance load coefficient, the model information representing the model of the printing apparatus 11, and the medium type information representing the type of the medium are associated with each other as a conveyance load coefficient database in the storage unit 220 on the basis of information sent from the printing apparatus 11. In the conveyance load coefficient database, the information about the date and time when the conveyance load coefficient is calculated, the model information representing the model of the printing apparatus 11 that has calculated the conveyance load coefficient, the medium type information representing the type of the medium whose conveyance load coefficient has been calculated, and the calculated conveyance load coefficient are associated with each other. In this manner, the information about the conveyance load coefficient calculated in the printing apparatus 11 is stored in the storage unit 220 of the server apparatus 200 as the conveyance load coefficient database, and thus the information about the conveyance load coefficient can be managed in a centralized manner.

In addition, the server apparatus 200 analyzes information including a conveyance load coefficient received from a plurality of the printing apparatuses 11, and specifies an optimum conveyance load coefficient for each model. When receiving a request from a given printing apparatus 11 through the communication interface 61, the server apparatus 200 transmits information about the conveyance load coefficient corresponding to the model of the printing apparatus 11 that has made the request to the printing apparatus 11 that has made the request. Specifically, the server apparatus 200 analyzes the information including the conveyance load coefficient acquired from a plurality of the printing apparatuses 11 preregistered on the Internet, and provides useful information including the optimum conveyance load coefficient obtained through the analysis to another printing apparatus 11 that is not set. The suitable value of the conveyance load coefficient may differ depending on the individual difference of the printing apparatus 11 and it is therefore preferable to calculate the conveyance load coefficient individually for each printing apparatus 11 by performing the preliminary conveyance, but it is also possible to provide a simple automatic adjustment mode such that when the simple automatic adjustment mode is selected, the current command value to be output in the main conveyance in printing is calculated using the conveyance load coefficient received from the server apparatus 200.

Figure 6:
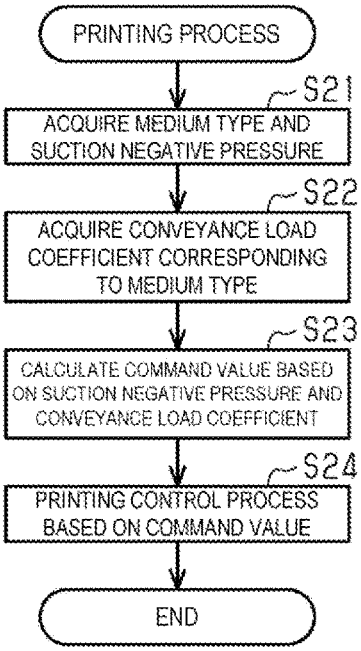
FIG. 6 is a flowchart of a printing process.

Next, with reference to FIG. 6, a printing process executed by the control unit 60 is described. This printing process is a process executed by the control unit 60 when printing job data is received from the host apparatus 150. The control unit 60 acquires printing condition information included in a printing job, or acquires printing condition information set through an operation on the operation unit 35. The printing condition information includes information about the printing mode, the type of the medium, the medium size, the suction negative pressure and the like.

As illustrated in FIG. 6, at step S21, the control unit 60 acquires the medium type and the suction negative pressure. In the present embodiment, the control unit 60 acquires the medium type and the suction negative pressure included in the printing condition information. In the case where the suction negative pressure is not included in the printing condition information, the suction negative pressure may be acquired by referring to the reference data on the basis of other information in the printing condition information. For example, the suction negative pressure may be acquired by the control unit 60 by referring to a reference table representing a correspondence relationship between the medium type and the suction negative pressure.

In addition, at step S22, the control unit 60 acquires the conveyance load coefficient corresponding to the medium type by reading it from the storage unit 71. In addition, the control unit 60 acquires the reference current command value corresponding to the type of the medium by reading it from the storage unit 71.

Next, at step S23, the control unit 60 calculates the current command value by correcting the reference current command value on the basis of the suction negative pressure and the conveyance load coefficient. Specifically, in the present embodiment, the control unit 60 calculates the current command value by multiplying the conveyance load coefficient and the suction negative pressure, and adding the result of the multiplication to the reference current command value.

Then, at step S24, the control unit 60 executes a printing control process based on the current command value. The control unit 60 rotates the exhaust fan 38 at a predetermined rotational speed at which the suction negative pressure based on the suction negative pressure information is obtained. The control unit 60 starts printing after it determines from a detection signal from the pressure sensor 39 that the pressure in the negative pressure chamber 37 has reached a specified suction negative pressure. The CPU 70 outputs, to the driving circuit 72, a distance command value that specifies the conveyance distance of the medium 99 to be conveyed in a single conveyance operation. The CPU 70 performs the speed control of the conveyance motor 65 by outputting the calculated current command value to the driving circuit 72. Specifically, the CPU 70 acquires the target speed corresponding to the current conveyance position by referring to the speed control data, and sequentially outputs the current command value corresponding to the acquired target speed. The current command value at this time is a command value that is corrected based on the suction negative pressure and the conveyance load coefficient. The CPU 70 performs a feedback-control of bringing the actual speed acquired based on a signal from the encoder 63 closer to the target speed. This feedback-control less causes following delay, overshooting and the like of the actual speed with respect to the target speed in comparison with a configuration of outputting a reference current command value, and the medium 99 stably accelerates at an acceleration almost as targeted.

In the present embodiment, a synchronization control is performed in which the feeding amount at the conveyance roller pair 25 and the feeding amount from the roll member 101 are matched to each other to maintain the tension of the portion of the medium 99 between the conveyance roller pair 25 and the roll member 101 within a predetermined range. The conveyance force of the conveyance roller pair 25 is determined on the premise that the tension of the medium 99 is within a predetermined range. That is, a reference current command value D0 output by the CPU 70 in the control unit 60 is determined on the premise that the tension of the medium 99 is within a predetermined range. For example, if following delay, in which the actual speed of the medium 99 conveyed by the conveyance roller pair 25 is delayed than a target speed, overshooting or the like occurs, the feeding amount at the conveyance roller pair 25 and the feeding amount from the roll member 101 cannot be matched to each other, and the tension of the medium 99 may deviate from a predetermined range. In this case, the deviation of the tension of the medium 99 from the predetermined range may result in wrinkles formed in the medium 99. In contrast, in the present embodiment, the CPU 70 in the control unit 60 outputs a current command value obtained by correcting the reference current command value D0 on the basis of the suction negative pressure and the conveyance load coefficient, and thus the tension of the medium 99 being conveyed easily falls within the predetermined range. In this manner, formation of wrinkles in the medium 99 is suppressed. The control unit 60 stops the driving of the conveyance motor 65 when the distance measured from the conveyance start position reaches a specified target conveyance distance on the basis of a signal from the encoder 63. Thus, a single conveyance operation is appropriately performed.

The control unit 60 prints an image based on the printing job on the medium 99 by alternately performing a conveyance operation of conveying the medium 99 to the next printing position and a printing operation of performing printing for one pass on the medium 99 at the printing unit 28. For example, if the feeding amount at the conveyance roller pair 25 and the feeding amount from the roll member 101 cannot be matched to each other and the tension of the medium 99 in the portion between the conveyance roller pair 25 and the roll member 101 deviates from a predetermined range, then the wrinkles formed in the medium 99 become gradually significant as the conveyance operation is performed. In this case, the wrinkled portion in the medium 99 printed by the printing unit 28 becomes a printing defect. In view of this, in the present embodiment, formation of wrinkles in the medium 99 can be suppressed, and therefore the printing defect of the above-mentioned type can be suppressed.

Next, an operational effect of the printing apparatus 11 is described.

In the printing apparatus 11, when the medium A is specified as the type of the medium whose conveyance load coefficient is not set, the preliminary conveyance is performed to measure the load determination value required for calculation of the conveyance load coefficient. In the present embodiment, the load determination value is the load current value of the conveyance motor 65. This load current value is acquired as a current command value that is output by the CPU 70 to the driving circuit 72 when the control unit 60 performs the speed control of the conveyance motor 65.

First, in the first preliminary conveyance, the exhaust fan 38 is rotated at the first rotational speed, and the medium 99 is suctioned toward the support part 22 by the first suction force with the first suction negative pressure p1 (see FIG. 4). The target conveyance speed corresponding to the printing mode is set. The CPU 70 outputs the reference current command value to the driving circuit 72. The driving circuit 72 supplies the current based on the reference current command value to the conveyance motor 65. The CPU 70 performs a feedback-control of correcting the reference current command value to a value for reducing the difference between the actual speed and the target speed, and outputting the corrected current command value to the driving circuit 72. At this time, at the medium 99, a conveyance load is generated due to a frictional force corresponding to the suction force, and therefore the current command value is corrected to a value greater than the reference current command value by an increment value for compensating the delay of the actual speed with respect to the target speed due to the conveyance load. Then, the control unit 60 stores, in the storage unit 71, the current command value output in the constant speed zone where the medium 99 is conveyed at a constant target conveyance speed, as the first current command value C11 measured in the first preliminary conveyance (see FIG. 4).

Next, in the second preliminary conveyance, the exhaust fan 38 is rotated at the second rotational speed, and the medium 99 is suctioned toward the support part 22 by the second suction force with the second suction negative pressure p2 (see FIG. 4). The CPU 70 outputs the reference current command value to the driving circuit 72. A current based on the reference current command value is supplied to the conveyance motor 65. The CPU 70 performs a feedback-control of correcting the current command value to a value for reducing the difference between the actual speed and the target speed, and outputting the corrected current command value to the driving circuit 72. At this time, a conveyance load is generated at the medium 99 due to a frictional force corresponding to the suction force, and therefore the value is corrected to a current command value that is greater than the reference current command value by an increment value for compensating the delay of the actual speed with respect to the target speed due to the conveyance load. Then, the control unit 60 stores, in the storage unit 71, the current command value output in the constant speed zone where the medium 99 is conveyed at a constant target conveyance speed, as the second current command value C12 measured in the second preliminary conveyance (see FIG. 4).

Then, through the use of the first suction negative pressure p1 and the first current command value C11 in the first preliminary conveyance and the second suction negative pressure p2 and the second current command value C12 in the second preliminary conveyance (see FIG. 4), the control unit 60 calculates the conveyance load coefficient μ1 using the equation μ1=(C12−C11)/(p2−p1). The control unit 60 stores, in the storage unit 71, the conveyance load coefficient μ1 in association with the medium A as the type of the medium. In addition, the control unit 60 transmits the conveyance load coefficient μ1 together with the date and time information, the model information and the medium type information to the server apparatus 200 through the communication interface 61 and the host apparatus 150.

In the printing apparatus 11, when the medium B as the type of the medium whose conveyance load coefficient is not set is specified, the preliminary conveyance is performed to measure the load determination value required for the calculation of the conveyance load coefficient. That is, the first preliminary conveyance and the second preliminary conveyance are performed. Then, through the use of the first suction negative pressure p1 and the first current command value C21 in the first preliminary conveyance and the second suction negative pressure p2 and the second current command value C22 in the second preliminary conveyance (see FIG. 4), the control unit 60 calculates the conveyance load coefficient μ2 using the equation μ2=(C22−C21)/(p2−p1). The control unit 60 stores, in the storage unit 71, the conveyance load coefficient μ2 in association with the medium B as the type of the medium. In addition, the control unit 60 transmits the conveyance load coefficient μ2 together with the date and time information, the model information and the medium type information to the server apparatus 200 through the communication interface 61 and the host apparatus 150.

On the other hand, in the server apparatus 200, the conveyance load coefficient is stored in the storage unit 220 as the conveyance load coefficient database together with the date and time information, the model information and the medium type information. In this manner, it is possible to perform centralized management of the conveyance load coefficient in association with the date and time information, the model information and the medium type information.

In addition, in the printing apparatus 11, when the main conveyance is performed by receiving data of a printing job from the host apparatus 150, the control unit 60 determines whether the conveyance load coefficient corresponding to the specified type of the medium is preset. When the conveyance load coefficient is preset, the control unit 60 reads the conveyance load coefficient corresponding to the medium type from the storage unit 71. The control unit 60 calculates the current command value through the use of the suction negative pressure and the conveyance load coefficient determined by the printing condition information, and the CPU 70 outputs the calculated current command value to the driving circuit 72, and thus, the speed control of the conveyance motor 65 is performed. As a result, even when the suction negative pressure of suctioning the medium 99 being conveyed differs, the target conveyance speed is reached with an acceleration of suppressing following delay, overshooting or the like of the actual speed with respect to the target speed in the acceleration zone of the medium 99 in the main conveyance, and the medium 99 is conveyed at the target conveyance speed. Thus, formation of wrinkles in the medium 99 is suppressed, and a high-quality image is printed on the medium 99.

As described in detail above, the present embodiment can provide the following effects.

(1) The current command value that changes in accordance with the conveyance load of the medium 99 is measured in the preliminary conveyance in which the medium 99 is conveyed by the conveyance unit 14 in the state where the suction force of the suction unit 30 is constant, and, on the basis of the current command value and the suction force, the conveyance load coefficient corresponding to the suction force of the suction unit 30 can be acquired as the conveyance parameter. (1) The current command value that changes in accordance with the conveyance load of the medium 99 is measured in the preliminary conveyance in which the medium 99 is conveyed by the conveyance unit 14 in the state where the suction force of the suction unit 30 is constant, and, on the basis of the current command value and the suction force, the conveyance load coefficient corresponding to the suction force of the suction unit 30 can be acquired as the conveyance parameter. Thus, even when the conveyance load is changed in accordance with the magnitude of the suction force, the medium 99 can be conveyed at an appropriate speed without causing following delay or overshooting on the basis of an appropriate current command value corresponding to the conveyance load.

(2) The conveyance load coefficient as one acquired conveyance parameter is transmitted to the server apparatus 200 through the communication interface 61 together with the medium type information representing the type of the medium 99. Thus, the server apparatus 200 can manage the conveyance load coefficient acquired from a plurality of the printing apparatuses 11 connected to the network NT in association with the type of the medium.

(3) In particular, as the preliminary conveyance, the first preliminary conveyance in which the medium 99 is conveyed by the conveyance unit 14 in the state where the suction force of the suction unit 30 is set to the predetermined first suction force, and the second preliminary conveyance in which the medium 99 is conveyed by the conveyance unit 14 in the state where the suction force of the suction unit 30 is set to the predetermined second suction force are performed. Then, the conveyance load coefficient corresponding to the suction force of the suction unit 30 can be acquired on the basis of the first current command value measured in the first preliminary conveyance and the second current command value measured in the second preliminary conveyance. Thus, the conveyance load coefficient based on the current command value measured in each preliminary conveyance and the suction force of the suction unit 30 can be acquired, and the accuracy of the conveyance load coefficient corresponding to the conveyance load of the medium 99 can be increased. For example, in the case of a configuration in which a general-purpose conveyance load coefficient is stored in advance in the storage unit 71, the influence of the individual difference of the printing apparatus 11 is not reflected in the conveyance load coefficient, and therefore the accuracy is low. In the present embodiment, on the basis of the suction forces and the current command values measured in the first preliminary conveyance and the second preliminary conveyance with different suction forces, the conveyance load coefficient in which the influence of the individual difference of the printing apparatus 11 is reflected is calculated, and thus an appropriate conveyance load coefficient that matches the individual difference of the printing apparatus 11 can be acquired.

(4) The medium 99 is conveyed at the same target conveyance speed for the first preliminary conveyance and the second preliminary conveyance. Thus, with the same target conveyance speed as a factor related to the conveyance load, the accuracy of the conveyance load coefficient representing the relationship between the suction force and the conveyance load can be increased.

(5) Since the conveyance load coefficient is acquired based on the load current value of the conveyance motor 65 in each preliminary conveyance, the conveyance load coefficient can be acquired from the load current value of the conveyance motor 65 that directly controls the conveyance motor 65 without printing an image on the medium 99 in each preliminary conveyance.

(6) In the preliminary conveyance, the conveyance load coefficient that enables determination of the relationship between the current command value and the rotational speed of the exhaust fan 38 can be acquired in accordance with the type of the medium, and thus the relationship between the suction force of the suction unit 30 and the conveyance motor 65 can be determined based on the conveyance load coefficient. Thus, even in the case where the rotational speed of the exhaust fan 38 is changed and the suction force of the suction unit 30 is changed without changing the type of the medium, the current command value corresponding to the rotational speed after the change can be calculated based on the conveyance load coefficient corresponding to the type of the medium. Accordingly, when the conveyance load coefficient corresponding to the type of the medium has been acquired, an appropriate current command value can be calculated without executing a process of measuring the current command value corresponding to the rotational speed even when the rotational speed of the exhaust fan 38 is changed.

(7) In the preliminary conveyance that is separate from the main conveyance, the conveyance load coefficient can be acquired, and the main conveyance can be performed based on the conveyance load coefficient acquired in the preliminary conveyance. Thus, in the main conveyance, the conveyance motor 65 can be controlled based on the conveyance load coefficient from the start, and an unsteady period can be shortened. Further, the conveyance control can be stably performed even in the unsteady period, and thus the conveyance accuracy in the main conveyance can be increased.

Second Embodiment

Next, a second embodiment of the present disclosure is described.

In the first embodiment, the conveyance load coefficient is calculated based on the current command value for conveying the medium 99 at the target conveyance speed. In the second embodiment, when a distance command value that specifies a target conveyance distance is output, an actual conveyance distance over which the medium 99 is actually conveyed is measured, and the conveyance load coefficient is calculated based on the actual conveyance distance. Specifically, in the preliminary conveyance, the actual conveyance distance is measured as an example of the load determination value. The first preliminary conveyance and the second preliminary conveyance are performed with the front end portion of the medium 99 fixed to the winding unit 18 while the medium 99 conveyed by the conveyance unit 14 is wound on the roll member 102. In the following description, the same configuration and control as those of the above-described embodiment are denoted with the same reference numerals, and overlapping descriptions are omitted or simplified.

In the second embodiment, in the printing apparatus 11, the CPU 70 in the control unit 60 performs a conveyance control of conveying the medium 99 by a specified conveyance distance at a specified target conveyance speed by outputting a reference current command value and a distance command value to the driving circuit 72. When the target conveyance speed is determined based on the printing condition information, the reference current command value is determined based on the speed control data corresponding to the target conveyance speed. While the reference current command value may be corrected using the conveyance load coefficients μ1 and μ2 for correcting the current command value as in the first embodiment, an example in which the current command value is not corrected is described in the present embodiment. Specifically, the reference current command value of the present embodiment corresponds to the current command value of the case where the rotational speed of the exhaust fan 38 is "0", i.e., the suction negative pressure is "0" in the first embodiment.

Here, the distance command value is a command value that commands the target conveyance distance. The driving circuit 72 uses the conveyance distance instructed by the distance command value input from the CPU 70 as the target conveyance distance. Then, when the conveyance distance that is measured based on a signal from the encoder 63 reaches the target conveyance distance after starting the driving of the conveyance motor 65 by supplying a current based on the current command value, the driving circuit 72 stops the driving of the conveyance motor 65.

In the present embodiment, in the preliminary conveyance, the actual conveyance distance over which the medium 99 is actually conveyed is measured as an example of the load determination value. In the preliminary conveyance, the medium 99 is conveyed by a reference conveyance distance. In the preliminary conveyance, the control unit 60 outputs, to the driving circuit 72, the distance command value in which the reference conveyance distance is the target conveyance distance. Here, in the case of a configuration in which the measurement pattern is printed in the preliminary conveyance, the reference conveyance distance is a distance corresponding to a predetermined pass number set in advance. The pass number represents the number of scans in which the printing unit 28 moves while discharging liquid to the medium 99. For the preliminary conveyance, it is possible to adopt a configuration in which the medium 99 is conveyed once at the target conveyance speed corresponding to the printing mode in the case of a configuration in which the measurement pattern is not printed, as well as a configuration in which the medium 99 is intermittently conveyed as in printing.

The actual conveyance distance over which the medium 99 is actually conveyed tends to be in inverse proportion to the suction negative pressure of the suction unit 30. The reason why the actual conveyance distance is shortened when the suction negative pressure is increased is that the frictional force received by the medium 99 from the support surface 22A is increased due to the suction force corresponding to the suction negative pressure acting on the medium 99, and consequently slippage occurs between the conveyance roller pair 25 and the medium 99.

The conveyance load coefficient is a conveyance parameter representing a relationship between the suction force of the suction unit 30 and the conveyance load of the medium 99. The conveyance load coefficient of the present embodiment is a coefficient representing a relationship (ratio) between the suction negative pressure and the actual conveyance distance. The conveyance load coefficient is a coefficient representing a reduction rate of the actual conveyance distance per unit suction negative pressure. The conveyance load coefficient is a coefficient used for calculation of correcting the target conveyance distance commanded with the distance command value in accordance with the suction negative pressure. That is, the conveyance load coefficient is a conveyance parameter used for calculation of the distance command value.

Figure 7:
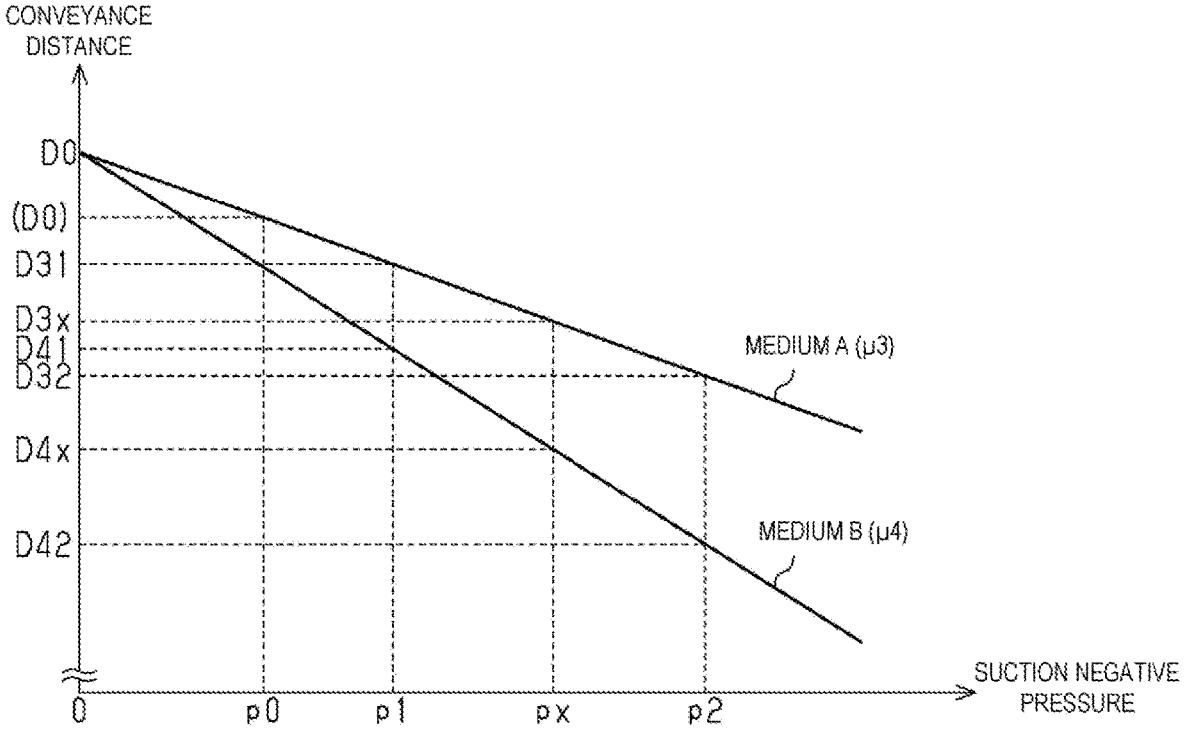
FIG. 7 is a schematic view illustrating a relationship between a conveyance distance of a medium and a suction negative pressure of a suction unit in a printing apparatus of a second embodiment.

More specifically, as illustrated in FIG. 7, when the medium type is the medium A, the conveyance load coefficient is μ3. A distance D0 is the reference conveyance distance. When the suction negative pressure is "0" and the conveyance motor 65 is controlled at the target conveyance speed corresponding to the medium A, the actual conveyance distance of the medium 99 coincides with the reference conveyance distance D0 when it is assumed that there is no slippage between the conveyance roller pair 25 and the medium 99. Note that in the graph illustrated in FIG. 7, the abscissa indicates the suction negative pressure in an absolute value p, and a relationship of $0<p1<px<p2$ holds.

A conveyance distance D3*x* of the medium 99 corresponding to the suction negative pressure px is calculated by adding a result of multiplication of a conveyance load coefficient μ3 and a suction negative pressure px of the suction unit 30 to the distance D0. Note that in the present embodiment, the conveyance load coefficient μ3 is a negative coefficient, and practically, a result of multiplication of the absolute value |μ3| of the conveyance load coefficient μ3 and the suction negative pressure px is subtracted from the distance D0. Then, when the medium 99 is conveyed by outputting the distance command value in which the distance D0 is the target conveyance distance, the difference (D0−D3*x*) between the reference conveyance distance D0 and the conveyance distance D3*x* corresponds to the amount of slippage between the conveyance roller pair 25 and the medium 99, which is increased than when the suction negative pressure is "0". The conveyance distance ratio obtained by dividing the distance D0 by the conveyance distance D3*x* is calculated. By multiplying the calculated ratio D0/D3*x* and the reference conveyance distance D0, the target conveyance distance of the medium 99 is calculated when the suction negative pressure is px in the case where the type of the medium is the medium A.

On the other hand, when the type of the medium is the medium B, the conveyance load coefficient is μ4, and in this case, the conveyance distance D4*x* of the medium 99 corresponding to the suction negative pressure px is calculated by adding a result of multiplication of the conveyance load coefficient μ4 and the suction negative pressure px to the distance D0. Note that in the present embodiment, the conveyance load coefficient μ4 is a negative coefficient (μ4<0). The difference (D0−D4*x*) between the reference conveyance distance D0 and the conveyance distance D4*x* corresponds to the amount of slippage between the conveyance roller pair 25 and the medium 99, which is increased than when the suction negative pressure is "0". A conveyance distance ratio obtained by dividing the distance D0 by the conveyance distance D4*x* is calculated. By multiplying the calculated ratio D0/D4*x* and the reference conveyance distance D0, the target conveyance distance of the medium 99 is calculated when the suction negative pressure is px in the case where the type of the medium is the medium B.

In FIG. 7, slippage may occur when the suction negative pressure is "0". In the present embodiment, the control unit 60 corrects the reference conveyance distance using the conveyance load coefficient such that the amount of slippage is adjusted to the amount of slippage of the case where suction negative pressure is "0" when the suction unit 30 is driven. In the case where no slippage occurs when the suction negative pressure is "0", no slippage occurs in the range from the suction negative pressure "0" to a predetermined negative pressure p0 and the actual conveyance distance is a constant value equal to the reference conveyance distance D0 as the medium A indicated by a chain double-dashed line in FIG. 7, for example. Then, when the suction negative pressure exceeds the predetermined negative pressure p0, the actual conveyance distance is reduced as the suction negative pressure is increased due to slippage. In a suction negative pressure range of 0 to p0, the gradient of the straight line of medium A is not μ3 but is "0". When the suction negative pressure falls within the suction negative pressure range of 0 to p0, no slippage occurs, and therefore the reference conveyance distance D0 is set to the target conveyance distance.

Therefore, the control unit 60 determines whether the absolute value p(>0) of the specified suction negative pressure is p>p0. When p≤p0 holds, the target conveyance distance is set to the reference conveyance distance D0. When p>p0 holds, the target conveyance distance is calculated by correcting the reference conveyance distance D0 through the use of the specified suction negative pressure and the conveyance load coefficient.

For example, in the case illustrated in FIG. 7 where the conveyance load coefficient is μ3, the control unit 60 determines whether the absolute value p(>0) of the specified suction negative pressure is p>p0. When p≤p0 holds, the reference conveyance distance D0 is set to the target conveyance distance. When p>p0 holds, the target conveyance distance is calculated by correcting the reference conveyance distance D0 through the use of the specified suction negative pressure and the conveyance load coefficient. That is, the control unit 60 calculates the target conveyance distance Dg using an equation $Dg=D0\cdot(D0/D3x)$. Here, D3*x* is given by an equation $D3x=D0+\mu3\cdot(px-p0)$. Accordingly, the target conveyance distance Dg is calculated using an equation $Dg=D0\cdot(D0/(D0+\mu3\cdot(px-p0)))$.

In the conveyance load coefficient measurement process of FIG. 5, at step S11, the control unit 60 executes the first preliminary conveyance process. The first preliminary conveyance process is a process of performing the first preliminary conveyance for measuring the conveyance load (hereinafter referred to as "first conveyance load") for conveying the medium 99 when the negative pressure chamber 37 is set to the first suction negative pressure by rotating the exhaust fan 38 at the first rotational speed. In this process, the control unit 60 outputs a signal for rotating the exhaust fan 38 at the first rotational speed to the exhaust fan 38. In this manner, the medium 99 is suctioned toward the support part 22 by the first suction force.

Then, the control unit 60 causes the printing unit 28 to print a measurement pattern on the medium 99. In the present embodiment, the measurement pattern is a pattern that enables determination of the conveyance distance of the medium 99 and is a ruled line pattern that extends in the width direction that intersects the conveyance direction of the medium 99. As such, the control unit 60 prints, on the medium 99, a measurement pattern that enables determination of the first reference position that is the measurement start position of the conveyance distance before conveyance in the first preliminary conveyance.

Next, the control unit 60 reads the reference current command value corresponding to the medium 99 from the storage unit 71, and outputs the current based on the reference current command value to the conveyance motor 65. In this case, the control unit 60 performs a feedback-control of bringing the actual speed of the conveyance motor 65 closer to the target speed corresponding to the reference current command value on the basis of a signal from the encoder 63. In addition, the control unit 60 determines whether the medium 99 is conveyed by the reference conveyance distance on the basis of the signal from the encoder 63, and when the control unit 60 determines that the medium 99 has been conveyed by the reference conveyance distance, the conveyance of the medium 99 is completed.

Then, the control unit 60 causes the printing unit 28 to print, on the medium 99, a measurement pattern that enables determination of the measurement end position of the conveyance distance. Specifically, the control unit 60 operates to print, on the medium 99, a measurement pattern that enables determination of the second reference position after the medium 99 is conveyed in the first preliminary conveyance. In this manner, the control unit 60 causes the printing unit 28 to print, on the medium 99, a measurement pattern that enables determination of the conveyance distance of the medium 99 in the first preliminary conveyance.

Next, the control unit 60 outputs a current based on a predetermined current command value to the conveyance motor 65, and conveys the medium 99 to a position where the image-capturing unit 62 can capture the images of the first reference position and the second reference position printed on the medium 99. Then, the control unit 60 causes the image-capturing unit 62 to capture the image of the measurement pattern printed on the medium 99, and stores the captured image data in the storage unit 71. Subsequently, the control unit 60 analyzes the captured image data, calculates the distance between the first reference position and the second reference position that are the positions of the measurement pattern printed on the medium 99, and stores, in the storage unit 71, the calculated distance as the first actual conveyance distance of the case where the conveyance is performed with the first conveyance load. In this manner, the control unit 60 performs the first preliminary conveyance of controlling the conveyance motor 65 to cause the conveyance unit 14 to convey the medium 99 in the state where the suction force of the suction unit 30 is set to the predetermined first suction force, and acquires the conveyance distance of the medium 99 on the basis of a result of image-capturing of the measurement pattern printed on the medium 99 at the image-capturing unit 62 in the first preliminary conveyance. In this manner, the image-capturing unit 62 of the present embodiment corresponds to an example of a detection unit that detects a measurement pattern.

Next, at step S12, the control unit 60 executes the second preliminary conveyance process. The second preliminary conveyance process is a process of performing the second preliminary conveyance for measuring the conveyance load (hereinafter referred to as "second conveyance load") for conveying the medium 99 when the negative pressure chamber 37 is set to the second suction negative pressure by rotating the exhaust fan 38 at the second rotational speed. In this process, the control unit 60 outputs a signal for rotating the exhaust fan 38 at the second rotational speed to the exhaust fan 38. In this manner, the medium 99 is suctioned toward the support part 22 by the second suction force.

Then, the control unit 60 causes the printing unit 28 to print a measurement pattern on the medium 99. In the present embodiment, the measurement pattern is a pattern that enables determination of the conveyance distance of the medium 99, and is a ruled line pattern that extends in the width direction that intersects the conveyance direction of the medium 99. As such, the control unit 60 operates to print, on the medium 99, a measurement pattern that enables determination of a third reference position that is the measurement start position of the conveyance distance before the medium 99 is conveyed the in first preliminary conveyance.

Next, the control unit 60 reads the reference current command value corresponding to the medium 99 from the storage unit 71, and outputs the current based on the reference current command value to the conveyance motor 65. In this case, the control unit 60 performs a feedback-control of bringing the actual speed of the conveyance motor 65 closer to the target speed corresponding to the reference current command value on the basis of a signal from the encoder 63. In addition, the control unit 60 determines whether the medium 99 is conveyed by the reference conveyance distance on the basis of the signal from the encoder 63, and when the control unit 60 determines that the medium 99 has been conveyed by the reference conveyance distance, the conveyance of the medium 99 is completed.

Then, the control unit 60 causes the printing unit 28 to print, on the medium 99, a measurement pattern that enables determination of the measurement end position of the conveyance distance. Specifically, the control unit 60 operates to print the measurement pattern on the medium 99 such that a fourth reference position after the medium 99 is conveyed in the second preliminary conveyance can be determined. In this manner, the control unit 60 causes the printing unit 28 to print, on the medium 99, the measurement pattern that enables determination of the conveyance distance of the medium 99 in the second preliminary conveyance.

Next, the control unit 60 outputs a current based on a predetermined current command value to the conveyance motor 65, and conveys the medium 99 to a position where the image-capturing unit 62 can capture the third reference position and the fourth reference position printed on the medium 99. Then, the control unit 60 causes the image-capturing unit 62 to capture the image of the medium 99, and stores the captured image data in the storage unit 71. Subsequently, the control unit 60 analyzes the captured image data, calculates the distance between the third reference position and the fourth reference position printed on the medium 99, and stores, in the storage unit 71, the calculated actual distance as the second actual conveyance distance of the case where the conveyance is performed with the second conveyance load. In this manner, the control unit 60 performs the second preliminary conveyance of controlling the conveyance motor 65 such that the conveyance unit 14 conveys the medium 99 in the state where the suction force of the suction unit 30 is set to the predetermined second suction force, and acquires the conveyance distance of the medium 99 on the basis of a result of image-capturing of the surface of the medium 99 at the image-capturing unit 62 in the second preliminary conveyance. In the present embodiment, the conveyance distance of the medium 99 corresponds to an example of the load determination value.

At step S13, the control unit 60 executes a conveyance load coefficient calculation process of calculating the conveyance load coefficient. In this process, the control unit 60 calculates a difference of the suction negative pressure that is the difference between the first suction negative pressure applied in the first preliminary conveyance and the second suction negative pressure applied in the second preliminary conveyance. In addition, the control unit 60 calculates a difference of the conveyance distance that is the difference between the first conveyance distance over which the medium 99 is actually conveyed in first preliminary conveyance and the second conveyance distance over which the medium 99 is actually conveyed in second preliminary conveyance. Then, the control unit 60 calculates the conveyance load coefficient on the basis of the ratio between the difference of the suction negative pressure and the difference of the conveyance distance. In this manner, the control unit 60 acquires the conveyance load coefficient on the basis of the measurement result obtained through the first preliminary conveyance and the second preliminary conveyance. In particular, in the conveyance load coefficient measurement process, the control unit 60 measures the conveyance distances based on image-capturing results of the image-capturing unit 62 regarding the measurement pattern printed through the processes of the two preliminary conveyances on the medium 99, and acquires the conveyance load coefficient on the basis of the measured conveyance distance data. At step S14, the control unit 60 stores the conveyance load coefficient in the storage unit 71. At step S15, the control unit 60 performs a conveyance load coefficient transmission process of transmitting the conveyance load coefficient. The control unit 60 transmits the date and time information, the model information, the medium type information, and the conveyance load coefficient to the server apparatus 200 through the host apparatus 150.

On the other hand, in the printing process of FIG. 6, at step S21, the control unit 60 acquires the medium type and the suction negative pressure. At step S22, the control unit 60 acquires the conveyance load coefficient corresponding to the medium type. At step S23, the control unit 60 calculates the distance command value by correcting the reference distance command value on the basis of the suction negative pressure and the conveyance load coefficient. Specifically, in the present embodiment, the control unit 60 calculates the conveyance distance by multiplying the suction negative pressure and the conveyance load coefficient, and adding the result of the multiplication to the reference conveyance distance D0. Then, the control unit 60 calculates the distance command value by multiplying the reference distance command value corresponding to the type of the medium by the ratio obtained by dividing the reference conveyance distance by the conveyance distance.

Next, an operational effect of the printing apparatus 11 is described.

In the printing apparatus 11, in the first preliminary conveyance, the exhaust fan 38 is rotated at the first rotational speed, and the medium 99 is suctioned toward the support part 22 by the first suction force. Then, while a current based on the reference current command value is output to the conveyance motor 65, a feedback-control is performed such that the driving amount of the current state is the target driving amount corresponding to the reference current command value. In addition, the printing unit 28 prints a measurement pattern on the medium 99 in the first preliminary conveyance. When the medium 99 is conveyed by the reference conveyance distance on the basis of a signal from the encoder 63, the conveyance of the medium 99 is completed. In addition, when slippage occurs between the conveyance roller pair 25 and the medium 99 due to a conveyance load resulting from reception of a frictional force corresponding to the suction force, the medium 99 is conveyed by a distance shorter than the reference conveyance distance. In addition, in the first preliminary conveyance, after the measurement pattern printed on the medium 99 has reached the image-capturing zone of the image-capturing unit 62, the captured image data is analyzed based on the captured image of the measurement pattern captured by the image-capturing unit 62 to measure a first conveyance distance D31 that is the distance from the line of the first reference position to the line of the second reference position in the measurement pattern. The first conveyance distance D31 is stored in the storage unit 71.

In the printing apparatus 11, in the second preliminary conveyance, the exhaust fan 38 is rotated at the second rotational speed, and the medium 99 is suctioned toward the support part 22 by the second suction force. Then, while a current based on the reference current command value is output to the conveyance motor 65, a feedback-control is performed such that the driving amount of the current state is the target driving amount corresponding to the reference current command value. In addition, in the second preliminary conveyance, the printing unit 28 prints a measurement pattern on the medium 99. When the medium 99 is conveyed by the reference conveyance distance on the basis of a signal from the encoder 63, the conveyance of the medium 99 is completed. In addition, when slippage occurs between the conveyance roller pair 25 and the medium 99 due to a conveyance load resulting from reception of a frictional force corresponding to the suction force, the medium 99 is conveyed by a distance shorter than the reference conveyance distance. In addition, in the second preliminary conveyance, after the measurement pattern printed on the medium 99 has reached the image-capturing zone of the image-capturing unit 62, the image data is analyzed on the basis of the captured image of the measurement pattern captured by the image-capturing unit 62 to measure a second conveyance distance D32 that is the distance from the line of the third reference position to the line of the fourth reference position in the measurement pattern. The second conveyance distance D32 is stored in the storage unit 71.

Then, the difference between the first suction negative pressure p1 and the second suction negative pressure p2 is calculated. In addition, the difference between the first conveyance distance D31 and the second conveyance distance D32 is calculated. Then, the conveyance load coefficient is calculated based on the difference (p2−p1) between the suction negative pressures of the preliminary conveyances and the difference (D32−D31) between the conveyance distances of the preliminary conveyances. That is, the conveyance load coefficient μ3 is calculated using μ3=(D32−D31)/(p2−p1). The conveyance load coefficient μ3 is stored in the storage unit 71. Likewise, for the medium B that differs in the type of the medium, the first preliminary conveyance and the second preliminary conveyance are performed under the same conditions. The conveyance load coefficient μ4 is calculated based on the difference (p2−p1) between the suction negative pressures of the preliminary conveyances and the difference (D42−D41) between the conveyance distances of the preliminary conveyances. That is, the conveyance load coefficient μ4 is calculated using μ4=(D42−D41)/(p2−p1). The conveyance load coefficient μ4 is stored in the storage unit 71. In addition, together with the date and time information, the model information and the medium type information, the conveyance load coefficients μ3 and μ4 are transmitted to the server apparatus 200 through the communication interface 61 and the host apparatus 150.

In addition, in the printing apparatus 11, when the main conveyance is performed by receiving data of a job from the host apparatus 150, the conveyance distance corresponding to the conveyance load coefficient and the suction negative pressure of the suction unit 30 is calculated after the conveyance load coefficient corresponding to the type of the medium is read from the storage unit 71, and the conveyance motor 65 is controlled based on the calculated conveyance distance. For example, in the case where the type is the medium A and the suction negative pressure is px, it is conveyed by only the conveyance distance D3*x* shorter than the conveyance distance D0, and therefore a correction of multiplying the reference conveyance distance D0 required at that time by D0/D3*x* is performed, and the conveyance distance after the correction is acquired. The control unit 60 outputs, to the driving circuit 72, the distance command value in which the target conveyance distance is the conveyance distance after the correction. As a result, even when slippage occurs between the conveyance roller pair 25 and the medium 99, the medium 99 is conveyed by the corrected conveyance distance with an extra distance corresponding to the slippage, and thus the medium 99 stops at the target position after being conveyed by the required reference conveyance distance D0.

As described in detail above, the present embodiment can provide the following effects in addition to (1), (2) and (6) of the first embodiment.

(7) On the basis of a result of image-capturing of the measurement pattern printed on the medium 99 in the preliminary conveyance, the conveyance distance is measured as an example of the load determination value. In this manner, on the basis of the measured conveyance distance and the suction negative pressure, the conveyance load coefficient representing a relationship between the suction negative pressure and the conveyance distance can be acquired. Thus, through the use of the conveyance parameter representing a relationship between the suction force and the conveyance distance, the accuracy of the conveyance distance can be increased even when the medium 99 is conveyed at the suction negative pressure different from that of the preliminary conveyance.

(8) In addition, when the conveyance load that acts on the medium 99 being conveyed exceeds the limitation of the friction between the conveyance roller 25 and the medium 99, slippage may occur between conveyance roller 25 and the medium 99. When slippage occurs, the conveyance distance of the medium 99 is shortened than when no slippage occurs, and is insufficient than the target conveyance distance. In view of this, even when slippage occurs as described above, the conveyance load coefficient that enables determination of the relationship between the suction negative pressure and the conveyance distance of the medium 99 can be acquired in association with the type of the medium in the preliminary conveyance. The control unit 60 can determine the target conveyance distance obtained by correcting the reference conveyance distance D0 through the use of the conveyance load coefficient and the suction negative pressure of the suction unit 30. Thus, for a preset type of the medium whose conveyance load coefficient is stored in the storage unit 71, the conveyance distance corresponding to the suction negative pressure can be calculated based on the conveyance load coefficient corresponding to the type of the medium even when that suction negative pressure is not used in the preliminary conveyance. In this manner, when the conveyance load coefficient corresponding to the type of the medium has been acquired, an appropriate target conveyance distance can be acquired by correcting the reference conveyance distance through the use of the conveyance load coefficient without performing the preliminary conveyance even when a suction negative pressure having a value different from that of the suction negative pressure used in the preliminary conveyance is set. Thus, even when a suction negative pressure different from that of the preliminary conveyance is set, an appropriate conveyance control can be performed by outputting an appropriate conveyance distance command value corresponding to the suction negative pressure. Since the actual conveyance distance of the medium 99 is less shifted from the reference conveyance distance, the conveyance distance accuracy is increased. Thus, the accuracy of conveyance position of the medium 99 is increased. As a result, a printing image with high printing position accuracy can be acquired.

Note that the above-mentioned embodiments may be modified as in modifications described below. Further, the above-mentioned embodiments and the modifications described below may be appropriately combined as another modification, or the modifications described below may be appropriately combined as another modification.

In the second embodiment, the image-capturing unit 62 may capture an image of the surface of an unprinted medium 99 to detect the moved length of the medium 99 on the basis of the captured image of the surface. The image-capturing unit 62 detects the conveyance distance of the medium 99 by capturing an image of the texture of the unprinted medium 99 and setting a portion of the texture as a characteristic portion per unit time, and, accumulating the movement amount of the characteristic portion per unit time while changing the characteristic portion. For example, the conveyance distance of the medium 99 is measured by capturing the image of the texture of the medium 99 at the image-capturing unit 62, and the conveyance load coefficient is calculated based on the conveyance distance of the medium 99 and the suction negative pressure. This eliminates the need for printing of the measurement pattern, and thus the conveyance load coefficient as the conveyance parameter can be acquired without consuming ink and the medium 99 in the preliminary conveyance.

In the above-mentioned modification, the installation position of the image-capturing unit 62 in the conveyance direction may be downstream of the printing unit 28 or upstream of the printing unit 28. In addition, in the above-mentioned modification, for example, it is possible to adopt a configuration in which the image-capturing unit 62 embedded in the support part 22 captures an image of the rear surface of the unprinted medium 99 being conveyed on the support surface 22A of the support part 22 instead of the configuration in which the image-capturing unit 62 attached on the carriage 29 captures an image of the surface of the unprinted medium 99. In this case, the image-capturing unit 62 measures the conveyance distance on the basis of a result of image-capturing of the texture of the rear surface of the medium 99.

In the second embodiment, an optical sensor that detects the measurement pattern printed on the medium 99 may be adopted instead of the image-capturing unit 62 that captures an image of the measurement pattern printed on the medium 99. In this case, the optical sensor corresponds to an example of the detection unit. The optical sensor detects the measurement pattern through the use of the difference in light reflectance based on the density difference between the base color of the medium 99 and the color of the measurement pattern. The measurement pattern is a plurality of lines orthogonal to the conveyance direction of the medium 99, and includes printed lines printed at the first reference position as the measurement start position of the conveyance distance and the second reference position as the measurement end position, for example. The control unit 60 performs preliminary conveyance of conveying the medium 99 by the target conveyance distance on the basis of a signal from the encoder 63. The control unit 60 measures the conveyance distance from the position where the first reference position line is detected by the optical sensor to the position where the second reference position line is detected by the optical sensor. In this case, the measurement pattern may be a scale line printed in advance on the medium 99. In the preliminary conveyance, the control unit 60 measures the actual conveyance distance by counting, with a counter (not illustrated), the number of scale lines detected by the optical sensor in the process of conveying the medium 99 from the measurement start position to the measurement end position. The conveyance condition may be changed between the printing process of printing the line as the measurement pattern at the printing unit 28, and the measurement process of measuring the conveyance distance. For example, it is possible to adopt a conveyance condition in which in the measurement process, the suction negative pressure is set to "0" or a smallest possible value such that slippage can be limited to an amount approximately equivalent to that of the case where the suction negative pressure is "0". In addition, slippage of the medium 99 in the measurement process may be suppressed by setting the conveyance speed of the measurement process to a value lower than that of the conveyance speed of the printing process. The control unit 60 acquires the conveyance load coefficient representing a relationship between the suction negative pressure and the conveyance distance on the basis of the conveyance distance acquired from the detection result of the measurement pattern at the optical sensor, and the suction negative pressure applied the medium 99. In this manner, the control unit 60 acquires the conveyance load coefficient on the basis of the detection result of the measurement pattern.

In the second embodiment, it is possible to perform preliminary conveyance in which the medium 99 on which a measurement pattern is printed in advance is conveyed and the printing at the printing unit 28 is not performed. In this case, the image-capturing unit 62 may be provided at a position upstream of the printing unit 28 in the conveyance direction.

In the second embodiment, as the measurement pattern, for example, a patch pattern that enables determination of the density of the print may be printed on the medium 99. The image-capturing unit 62 may capture an image of the patch pattern to measure the conveyance distance of the medium 99, and the conveyance load coefficient may be acquired based on the conveyance distance of the medium 99 and the suction negative pressure.

In the second embodiment, the control unit 60 may adjust the nip force of the conveyance roller pair 25 to a stronger force by controlling the nip force adjustment mechanism when it determines that there is slippage in an amount that exceeds a threshold between the conveyance roller pair 25 and the medium 99 on the basis of the conveyance distance acquired in the preliminary conveyance.

While the control unit 60 controls the conveyance motor 65 on the basis of calculated current command value, this is not limitative. For example, it is possible to calculate one or both of the current command value to the feeding motor 16 and the current command value to the winding motor 19 to control one or both of the feeding motor 16 and the winding motor 19 on the basis of the calculated current command value. Specifically, in the preliminary conveyance, the current command value that controls the feeding motor 16 or the winding motor 19, or the feeding distance or the winding distance is measured, and the conveyance load coefficient is calculated based on the measured current command value and the suction negative pressure, or, the conveyance load coefficient is calculated based on the feeding distance or the winding distance and the suction negative pressure. The conveyance load coefficient is stored in storage unit 71 in association with the type of the medium, and is transmitted to the server apparatus 200. The CPU 70 in the control unit 60 performs a conveyance control of conveying the medium 99 by outputting, to the driving circuit 72, the current command value in which the reference current command value is corrected using the conveyance load coefficient corresponding to the medium type, or the distance command value that specifies the target conveyance distance in which the reference conveyance distance is corrected. Since the conveyance motor 65 and the feeding motor 16 can be controlled at an appropriate drive speed or in an appropriate driving amount, the tension of the medium 99 at a portion between the roll member 101 and the conveyance roller pair 25 can be limited within an appropriate range. In addition, since the conveyance motor 65 and the winding motor 19 can be controlled at an appropriate drive speed or in an appropriate driving amount in the printing apparatus 11 that does not include the tension bar 20, the tension of the medium 99 at a portion between the conveyance roller pair 25 and the roll member 102 can be limited to a value falling within an appropriate range.

The control unit 60 may determine whether the conveyance load coefficient corresponding to the type of the medium is stored in the storage unit 71, and, when the control unit 60 determines that the conveyance load coefficient is stored in the storage unit 71, the control unit 60 may not newly calculate the conveyance load coefficient, without executing the conveyance load coefficient measurement process.

In the printing apparatus 11, the control unit 60 may receive the model of the printing apparatus 11 and the conveyance load coefficient corresponding to the type of the medium from the server apparatus 200 through the host apparatus 150, and may store it in storage unit 71. In this case, while the model of the printing apparatus 11 and the conveyance load coefficient corresponding to the medium type are stored in the storage unit 220 in the server apparatus 200, the printing apparatus 11 cannot receive the conveyance load coefficient from the server apparatus 200 when the type is a new medium type that is not stored in the server apparatus 200. In view of this, when a conveyance load coefficient corresponding to a new medium type is calculated in the printing apparatus 11, the calculated conveyance load coefficient is transmitted from the printing apparatus 11 to the server apparatus 200, and the control unit 210 in the server apparatus 200 stores, in the storage unit 220, the conveyance load coefficient corresponding to the new type of the medium. In addition, the control unit 210 may transmit the conveyance load coefficient corresponding to the new type of the medium to another printing apparatus 11. In this manner, a conveyance load coefficient calculated in one printing apparatus 11 may be referred to in another printing apparatus 11.

For example, when an error such as a conveyance error of the medium 99 occurs, the control unit 60 may transmit, to the server apparatus 200, error information indicating occurrence of an error together with operation condition information including the model of the printing apparatus 11, the type of the medium when the error has occurred, the printing mode, the suction negative pressure and the conveyance load coefficient. In this case, in the server apparatus 200, the control unit 210 stores, in the storage unit 220, the operation parameter such as the type of the medium, the printing mode, the suction negative pressure, and the conveyance load coefficient and the error information in association with each other for each model of the printing apparatus 11. The control unit 210 of the server apparatus 200 can recognize the condition under which that type of error has occurred on the basis of the operation parameter such as the type of the medium, the printing mode, the suction negative pressure and the conveyance load coefficient corresponding to the error information for each model of the printing apparatus 11. Then, on the basis of the condition under which the error has occurred, the control unit 210 estimates an error occurrence condition that the frequency of error occurrence becomes equal to or greater than a reference frequency for each operation parameter, for example. On the basis of an estimation result, the control unit 210 determines an error avoidance condition that can avoid the occurrence of errors for each parameter, and stores it in the storage unit 220. When receiving the error information and the operation condition information from the printing apparatus 11, the control unit 210 checks the details of the error and the operation condition information specified from the error information against the error avoidance condition stored in the storage unit 220. From the result of the check, the control unit 210 specifies the operation parameter causing that type of error, determines the recommended setting range for the specified operation parameter, and transmits the determined error elimination information to the host apparatus 150. The host apparatus 150 displays the setting range of the specific parameter recommended for eliminating the error on a display unit (not illustrated) provided in the monitor or the printing apparatus 11 on the basis of the error elimination information.

The control unit 60 may measure the conveyance load coefficient on the basis of environment information, in addition the rotational speed of the exhaust fan 38. For the environment information, at least one of temperature and humidity may be employed. In this case, for example, the printing apparatus 11 may include at least one of a temperature detection unit that detects the temperature and a humidity detection unit that detects the humidity, and may measure the conveyance load coefficient corresponding to the detection result. In this case, also during the printing, the control unit 60 acquires the detection result of at least one of the temperature and the humidity, reads the conveyance load coefficient corresponding to the acquired detection result from the storage unit 71, and calculates the current command value to be set.

Even when the model of the printing apparatus 11 differs, similar models having a common function of the suction unit 30 and the like can share the conveyance load coefficient. In addition, even when the type of the medium differs, similar mediums having a common coefficient of friction, a common air permeability and the like can share the conveyance load coefficient.

While the first preliminary conveyance and the second preliminary conveyance are performed in each embodiment, it is also possible to perform only a single preliminary conveyance. For example, a configuration in which the load determination value is measured in the initial conveyance is adopted for a configuration in which slippage occurs even when the absolute value p of the suction negative pressure is p=0, or slippage occurs when p>0 although no slippage occurs when p=0 in the initial conveyance. Then, the control unit 60 may calculate the conveyance load coefficient through the use of information including the suction negative pressure "0" and the load determination value measured in the initial conveyance, and information including the suction negative pressure (≠0) and the load determination value measured in the single preliminary conveyance.

While the first preliminary conveyance and the second preliminary conveyance are performed in each embodiment, a single preliminary conveyance may be performed. For example, combination information of the suction negative pressure and the load determination value transmitted from another printing apparatus 11 of the same model to the server apparatus 200 is received from the server apparatus 200. The control unit 60 calculates the conveyance load coefficient through the use of the combination information received from the server apparatus 200 and the combination information including the suction negative pressure and the load determination value measured in the single preliminary conveyance.

While, in each embodiment, the conveyance load coefficient as an example of the conveyance parameter is calculated through the use of each measurement value measured through the first preliminary conveyance and the second preliminary conveyance, and the conveyance load coefficient is transmitted to the server apparatus 200 together with model information and medium type information, the conveyance load coefficient may not be transmitted to the server apparatus 200. For example, instead of the conveyance load coefficient, only the combination information of the suction force (or the suction negative pressure) and the load determination value measured in the preliminary conveyance may be transmitted to the server apparatus 200. In this case, the preliminary conveyance performed in the printing apparatus 11 may be performed twice as the first preliminary conveyance and the second preliminary conveyance, or may be performed only once. In addition, the combination information of the suction negative pressure and the load determination value measured in the preliminary conveyance and the conveyance load coefficient as an example of the conveyance parameter may be transmitted to the server apparatus 200 together with medium type information. Note that the combination information of the suction negative pressure and the load determination value measured in the preliminary conveyance corresponds to the parameter determination information that enables determination of the conveyance parameter. In addition, the parameter determination information is not limited to the combination information as long as the information includes the suction negative pressure and the load determination value measured in the preliminary conveyance.

The target conveyance speed of the first preliminary conveyance and the target conveyance speed of the second preliminary conveyance may be different from each other. For example, even in the case where the target conveyance speeds are different from each other, the conveyance load coefficient of the required accuracy can be acquired when the difference in the conveyance load with a suction negative pressure of "0" is negligibly small.

While the conveyance parameter of the current command value is acquired in the first embodiment and the conveyance parameter of the distance command value is acquired in the second embodiment, both conveyance parameters may be acquired. That is, the control unit 60 measures the first current command value and the first actual conveyance distance as examples of the load determination value in the first preliminary conveyance in which the medium 99 is conveyed under the first suction force. In addition, the control unit 60 measures the second current command value and the second actual conveyance distance in the second preliminary conveyance in which the medium 99 is conveyed under the second suction force. The control unit 60 calculates the conveyance load coefficient that is the conveyance parameter that defines the current command value on the basis of the first current command value and the first suction force, and the second current command value and the second suction force. In addition, the control unit 60 calculates the conveyance load coefficient that is the conveyance parameter that defines the distance command value on the basis of the first actual conveyance distance and the first suction force, and the second actual conveyance distance and the second suction force.

The suction unit 30 may adopt an electrostatic suction method of suctioning a charged medium 99 using an electrostatic force instead of a negative pressure suction method of generating a suction force using a suction negative pressure. In the case of the electrostatic suction method, an electric field may be generated between the suction unit 30 and the medium 99. In addition, at the surface opposite to the medium 99 in the suction unit 30, a first electrode connected to the high voltage side of the power source and a second electrode connected to the low voltage side of the power source may be disposed side by side to generate an electrostatic force by generating an electric field across the first electrode and the second electrode.

While the load current of the conveyance motor 65 is indirectly acquired from the current command value in the first embodiment, the load current of the conveyance motor 65 may be acquired by detecting it using a sensor. In the second embodiment, in the case where the printing apparatus 11 is a multifunctional apparatus, the medium 99 on which a measurement pattern has been printed may be set to an image reading unit by the user such that the measurement pattern is read by the image reading unit. In this case, the control unit 60 analyzes the image read by the image reading unit, and determines, as the actual conveyance distance, the distance between the measurement patterns such as lines printed at the measurement start position and the measurement end position.

The current command value is not limited as long as it is a command value for controlling the load current of the conveyance motor 65, and may be a command value that commands a duty value of a PWM control or a command value that commands a voltage to the driving circuit 72 as long as the load current of the conveyance motor 65 is controlled.

In each embodiment, it suffices that the information transmitted by the control unit 60 of the printing apparatus 11 to the server apparatus 200 includes the medium type information representing the type of the medium and the calculated conveyance load coefficient. For example, the information may include only the medium type information and the conveyance load coefficient.

For the types of the medium that are available as of the time when the printing apparatus 11 is sold, the conveyance load coefficients associated with the types of the medium may be stored in advance in the storage unit 71 or may be downloaded from the server apparatus 200 at the start of the use of the printing apparatus 11. In this case, for a new type of the medium released after the sale of the printing apparatus 11, the printing apparatus 11 performs preliminary conveyance of the medium 99 to acquire the conveyance load coefficient associated with the type of the medium. Note that it is possible to adopt a configuration in which the preliminary conveyance is performed to acquire the conveyance load coefficient associated with the type of the medium for all the types of the medium.

In each embodiment, the network NT is not limited to the Internet, and may be a local area network (LAN).

In each embodiment, the external apparatus is not limited to the server apparatus 200. It may be the host apparatus 150 as long as is it communicatively connected to a plurality of the printing apparatuses 11. In a configuration in which a plurality of the printing apparatuses 11 is communicatively connected to each other through a network, the external apparatus may be another printing apparatus. In this case, the conveyance parameter or the parameter determination information may be transmitted to each other to share it between the printing apparatuses 11 connected to a common network. In this case, it is possible to adopt a configuration in which one of the plurality of the printing apparatuses 11 is a managing printing apparatus, and the printing apparatus 11 transmits the conveyance parameter or the parameter determination information to the managing printing apparatus.

The printing apparatus 11 may include a nip force adjustment mechanism that switches the nip force between the driving roller 25A and the driven roller 25B. In this case, the nip force may be switched through a control of the adjustment mechanism by the control unit 60, or the nip force may be switched through an operation of a lever (not illustrated) by the user. The conveyance roller pair 25 that nips the medium 99 being conveyed may be referred to as a pressing part that presses the medium 99. When the pressure force of the pressing part such as the nip force increases, the conveyance load of the medium 99 increases. A preliminary conveyance in which the medium 99 is conveyed in the state where the pressing part is set to a constant pressure force may be performed to acquire the conveyance load coefficient on the basis of the preliminary conveyance. In other words, it suffices that the printing apparatus 11 includes a conveyance load application unit that applies a conveyance load to the medium 99, and that the conveyance load application unit includes at least the suction unit 30 of the suction unit 30 and the pressing part.

For the printing apparatus 11, a non-winding method in which the printed medium 99 is not wound up may be employed, or a configuration in which one of a winding method of winding up the printed medium 99 and the non-winding method can be selected may be employed. Note that in the non-winding method, the medium 99 may be housed a medium reception unit (not illustrated) in an uncut long form, or the medium 99 that is cut after the printing may be dropped to a sheet (not illustrated) placed on the floor. The printing apparatus 11 may convey the printed medium 99 to another apparatus including a winding apparatus. In addition, the printing apparatus 11 may has a configuration in which the feeding unit 15 is not provided and the printing unit 28 that prints the medium 99 fed from the feeding unit 15 provided in another apparatus is provided.

The conveyance path is not limited to the conveyance path having a trapezoidal shape in side view, and the conveyance path may have any path shape such as a horizontally extending conveyance path that is flat in its entirety.

The medium 99 is not limited to a sheet, and may be a film made of a synthetic resin, a sheet, cloth, non-woven fabric, a laminate sheet or the like. In addition, the medium 99 is not limited to a long medium such as roll paper, and may be a single-cut sheet.

The printing apparatus 11 may be a multifunctional apparatus having a scanner function and a copy function, in addition to a printing function.

In the above-mentioned embodiment, some or all of the functions of the host apparatus 150 may be mounted in the printing apparatus 11.

In the above-mentioned embodiment, the printing apparatus 11 and the server apparatus 200 may be directly communicatively connected to each other without interposing the host apparatus 150 therebetween. In this case, the host apparatus 150 may not be provided.

The technical ideas derived from the embodiments and modifications are described below with their effects.

A printing apparatus includes a conveyance unit configured to convey a medium, a suction unit configured to suction the medium at a support part configured to support the medium, a printing unit configured to perform printing on the medium supported by the support part, a control unit configured to control the conveyance unit, the suction unit and the printing unit, and a communication interface configured to communicate with an external apparatus. The control unit performs preliminary conveyance in which the conveyance unit conveys the medium in a state where the suction unit performs suction at a predetermined suction force, measures a load determination value that changes in accordance with a conveyance load of the medium in the preliminary conveyance, acquires a conveyance parameter representing a relationship between a suction force of the suction unit and the conveyance load on a basis of the load determination value and the suction force, and transmits, to the external apparatus through the communication interface, the acquired conveyance parameter or parameter determination information, together with medium type information about a type of the medium, the parameter determination information including the measured load determination value and the suction force.

With this configuration, the load determination value that changes in accordance with the conveyance load of the medium is measured in the preliminary conveyance in which the medium is conveyed by the conveyance unit in the state where the suction unit performs suction at a predetermined suction force, and the conveyance parameter representing the relationship between the suction force and the conveyance load can be acquired on the basis of the load determination value and the suction force. The conveyance parameter is acquired in association with the type of the medium. Thus, the conveyance parameter corresponding to the type of the medium can be acquired also for the medium type whose load conveyance parameter representing the relationship between the suction force and the conveyance is unknown. For example, even when the medium is conveyed with a suction force different from that of the preliminary conveyance, the control unit can appropriately control the conveyance unit on the basis of the conveyance parameter without performing the preliminary conveyance. Thus, when the medium is conveyed with a suction force different from that of the preliminary conveyance, the medium can be appropriately conveyed in accordance with the type of the medium and the suction force without performing the preliminary conveyance.

In addition, the acquired conveyance parameter or the parameter determination information including the measured load determination value and the suction force is transmitted to the external apparatus through the communication interface together with the medium type information of the type of the medium. Thus, the conveyance parameter associated with the type of the medium can be shared with the external apparatus.

In the printing apparatus, the control unit may perform first preliminary conveyance and second preliminary conveyance as the preliminary conveyance to acquire the conveyance parameter, the first preliminary conveyance being a conveyance in which the conveyance unit conveys the medium in a state where the suction unit performs suction with a predetermined first suction force, the second preliminary conveyance being a conveyance in which the conveyance unit conveys the medium in a state where the suction unit performs suction with a predetermined second suction force, the conveyance parameter being acquired by the control unit on a basis of a first load determination value measured in the first preliminary conveyance and the first suction force, and a second load determination value measured in the second preliminary conveyance and the second suction force.

With this configuration, the conveyance parameter representing the relationship between the suction force of the suction unit and the conveyance load can be acquired based on the first suction force and the first load determination value measured in the first preliminary conveyance as the preliminary conveyance in which the medium is conveyed in the state where the suction unit performs suction with the predetermined first suction force, and the second suction force and the second load determination value measured in the second preliminary conveyance as the preliminary conveyance in which the medium is conveyed in the state where the suction unit performs suction with the predetermined second suction force. Thus, an appropriate conveyance parameter that matches the individual difference of the printing apparatus can be acquired.

In the printing apparatus, a target conveyance speed for conveying the medium in the first preliminary conveyance and a target conveyance speed for conveying the medium in the second preliminary conveyance may be equal to each other.

With this configuration, the medium is conveyed at the same target conveyance speed for the first preliminary conveyance and the second preliminary conveyance so as to use the same target conveyance speed as a factor related to the conveyance load, and thus the accuracy of the conveyance parameter corresponding to the conveyance load of the medium can be increased.

In the printing apparatus, the conveyance unit may include a conveyance motor, driving of which is controlled by the control unit, the load determination value may be a load current value of the conveyance motor, and the control unit may acquire the conveyance parameter on a basis of the suction force and the load current value of the conveyance motor in the preliminary conveyance. Note that the load current value of the conveyance motor may be directly measured using a sensor or the like, or the load current of the conveyance motor may be indirectly measured based on a command value for controlling the conveyance motor.

With this configuration, the conveyance parameter representing the relationship between the suction force and the load current value can be acquired by measuring the load current value of the conveyance motor in the preliminary conveyance. Thus, with the conveyance parameter, the accuracy of the current value to be supplied to the conveyance motor can be increased even when a medium is conveyed with a suction force different from that of the preliminary conveyance.

In the printing apparatus, an image-capturing unit configured to capture a surface image of the medium may be provided, the load determination value may be a conveyance distance of the medium, and the control unit may measure the conveyance distance of the medium on a basis of a result of image-capturing, by the image-capturing unit, of the surface image of the medium in the preliminary conveyance and acquires the conveyance parameter on a basis of the conveyance distance and the suction force.

With this configuration, the conveyance distance is measured as the load determination value that changes in accordance with the conveyance load of the medium on the basis of a result of image-capturing of the surface of the medium in the preliminary conveyance. The conveyance parameter representing a relationship between the suction force and the conveyance distance can be acquired based on the measured conveyance distance and the suction force. Thus, with the conveyance parameter, the accuracy of the conveyance distance can be increased even when the medium is conveyed with a suction force different from that of the preliminary conveyance.

In the printing apparatus, a detection unit configured to detect a measurement pattern that is printed on the medium in so as to enable determination of a conveyance distance may be provided, the load determination value may be a conveyance distance of the medium, and the control unit may cause the printing unit to print the measurement pattern on the medium in the preliminary conveyance, acquires the conveyance distance of the medium on a basis of a detection result of the measurement pattern of the medium detected by the detection unit and acquires the conveyance parameter on a basis of the conveyance distance and the suction force.

With this configuration, the measurement pattern that enables determination of the conveyance distance of the medium in the preliminary conveyance is printed on the medium, and the conveyance distance that changes in accordance with the conveyance load of the medium is measured on the basis of the detection result obtained by detecting the measurement pattern of the medium. The conveyance parameter representing a relationship between the suction force and the conveyance distance is acquired using the measured conveyance distance and the suction force. Thus, with the conveyance parameter, the accuracy of the conveyance distance can be increased even when the medium is conveyed with a suction force different from that of the preliminary conveyance.

What is claimed is:

1. A printing apparatus comprising:

a conveyance unit configured to convey a medium;

a suction unit configured to suction the medium at a support part configured to support the medium;

a printing unit configured to perform printing on the medium supported by the support part;

a control unit configured to control the conveyance unit, the suction unit and the printing unit; and a communication interface configured to communicate with an external apparatus, wherein the control unit performs preliminary conveyance for conveying the medium by the conveyance unit in a state where the suction unit performs suction at a predetermined suction force, measures a load determination value that changes in accordance with a conveyance load of the medium in the preliminary conveyance, acquires a conveyance parameter representing a relationship between a suction force of the suction unit and the conveyance load on a basis of the load determination value and the suction force, and transmits, to the external apparatus through the communication interface, the acquired conveyance parameter or parameter determination information, together with medium type information about a type of the medium, the parameter determination information including the measured load determination value and the suction force, the control unit performs, as the preliminary conveyance, first preliminary conveyance in which the conveyance unit conveys the medium in a state where the suction unit performs suction with a predetermined first suction force and second preliminary conveyance in which the conveyance unit conveys the medium in a state where the suction unit performs suction with a predetermined second suction force, and acquires the conveyance parameter on a basis of a first load determination value measured in the first preliminary conveyance and the first suction force, and a second load determination value measured in the second preliminary conveyance and the second suction force.

2. The printing apparatus according to claim 1, wherein a target conveyance speed for conveying the medium in the first preliminary conveyance and a target conveyance speed for conveying the medium in the second preliminary conveyance are equal to each other.

3. The printing apparatus according to claim 1, wherein the conveyance unit includes a conveyance motor, driving of which is controlled by the control unit;

the load determination value is a load current value of the conveyance motor; and the control unit acquires the conveyance parameter on a basis of the suction force and the load current value of the conveyance motor in the preliminary conveyance.

4. The printing apparatus according to claim 1, comprising an image-capturing unit configured to capture a surface image of the medium, wherein the load determination value is a conveyance distance of the medium; and the control unit measures the conveyance distance of the medium on a basis of a result of image-capturing, by the image-capturing unit, of the surface image of the medium in the preliminary conveyance and acquires the conveyance parameter on a basis of the conveyance distance and the suction force.

5. The printing apparatus according to claim 1, comprising a detection unit configured to detect a measurement pattern that is printed on the medium so as to enable determination of a conveyance distance, wherein the load determination value is a conveyance distance of the medium; and the control unit causes the printing unit to print the measurement pattern on the medium in the preliminary conveyance, acquires the conveyance distance of the medium on a basis of a detection result of the measurement pattern of the medium detected by the detection unit, and acquires the conveyance parameter on a basis of the conveyance distance and the suction force.

* * * * *